US010865798B2

(12) United States Patent
Lin et al.

(10) Patent No.: US 10,865,798 B2
(45) Date of Patent: Dec. 15, 2020

(54) FAN COIL UNIT

(71) Applicant: Zhongshan Broad-Ocean Motor Co., Ltd., Zhongshan (CN)

(72) Inventors: Yanhu Lin, Zhongshan (CN); Caisheng Tan, Zhongshan (CN); Jinren Guan, Zhongshan (CN); Jianhui Li, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 97 days.

(21) Appl. No.: 15/866,442

(22) Filed: Jan. 9, 2018

(65) Prior Publication Data

US 2018/0128275 A1 May 10, 2018

Related U.S. Application Data

(63) Continuation-in-part of application No. PCT/CN2017/077699, filed on Mar. 22, 2017, and a
(Continued)

(30) Foreign Application Priority Data

May 30, 2016 (CN) ..... 2016 1 0375538
May 30, 2016 (CN) ..... 2016 2 0514736 U
Sep. 22, 2016 (CN) ..... 2016 1 0842173

(51) Int. Cl.
*F04D 25/08* (2006.01)
*F04D 25/16* (2006.01)
(Continued)

(52) U.S. Cl.
CPC ..... *F04D 25/08* (2013.01); *F04D 25/16* (2013.01); *F04D 25/166* (2013.01);
(Continued)

(58) Field of Classification Search
CPC .... F04D 29/664; F04D 29/5826; F04D 25/08; F04D 25/166; F24F 2013/205;
(Continued)

(56) References Cited

U.S. PATENT DOCUMENTS 2,001,522 A * 5/1935 Chester ..... F04D 29/462 415/148
2,387,348 A * 10/1945 Place ..... F04D 25/166 415/131
(Continued)

FOREIGN PATENT DOCUMENTS

CN 202628562 U 12/2012
CN 203857561 U 10/2014
(Continued)

OTHER PUBLICATIONS

A new concept for squirrel-cage fan inlet, by Montazerin, published 1998 (Year: 1998).*
(Continued)

*Primary Examiner* — Charles G Freay
*Assistant Examiner* — Thomas Fink
(74) *Attorney, Agent, or Firm* — Matthias Scholl P.C.; Matthias Scholl

(57) ABSTRACT

A fan coil unit, including: a blower including a volute, a wind wheel, and a motor; a fan housing; a heat exchanger; and a hydrostatic plate. The volute includes a first chamber, a first air inlet, and a first air outlet. The wind wheel is disposed in the first chamber of the volute. The motor includes an output shaft which extends into the first chamber and is connected to the wind wheel. The fan housing includes a second chamber, a second air inlet, and a second air outlet. The heat exchanger is disposed in the second chamber and is located between the second air inlet and the second air outlet. The volute further includes a volute tongue
(Continued)

which is close to the first air outlet. The hydrostatic plate is connected to the volute tongue. The hydrostatic plate includes an upper end and a lower end.

19 Claims, 24 Drawing Sheets

Related U.S. Application Data continuation-in-part of application No. PCT/CN2016/098489, filed on Sep. 8, 2016.

(51) Int. Cl.
*F04D 29/58* (2006.01)
*F04D 29/041* (2006.01)
*F04D 29/26* (2006.01)
*F04D 17/16* (2006.01)

(52) U.S. Cl.
CPC ..... *F04D 29/0413* (2013.01); *F04D 29/263* (2013.01); *F04D 29/5826* (2013.01); *F04D 17/16* (2013.01)

(58) Field of Classification Search
CPC ..... F24F 1/0025; F24F 1/028; F24F 1/0284; B60H 1/00564; B60H 1/0052; B60H 1/00528
See application file for complete search history.

(56) References Cited

U.S. PATENT DOCUMENTS 3,073,296 A * 1/1963 Hollingsworth ..... F24H 3/105 126/110 R
3,174,682 A * 3/1965 Wilfert ..... F04D 29/4226 415/119
3,312,389 A * 4/1967 Matsui ..... F04D 29/664 415/119
3,485,443 A * 12/1969 Earhart ..... F04D 29/424 415/200
3,540,547 A * 11/1970 Coward, Jr. ..... F04D 29/664 181/225
3,977,467 A * 8/1976 Northrup, Jr. ..... F04D 29/424 415/200
4,174,020 A * 11/1979 Challis ..... F04D 29/424 181/211
5,110,258 A * 5/1992 Morinushi ..... B60H 1/00564
5,855,469 A * 1/1999 McConnell ..... F01D 11/10 415/171.1
6,041,853 A * 3/2000 Edayoshi ..... F24F 1/0007 165/122
6,105,383 A * 8/2000 Reimann ..... B60H 1/00371 62/244
6,318,109 B1 * 11/2001 Reimann ..... F24F 1/0011
6,588,228 B2 * 7/2003 Choi ..... F04D 29/4226 415/204
2005/0260071 A1 11/2005 Hsu et al.
2007/0059167 A1 * 3/2007 Hancock ..... F04D 29/4226 415/206
2007/0256816 A1 * 11/2007 Higashida ..... F24F 1/0007 165/120
2010/0074743 A1 * 3/2010 Jairazbhoy ..... F03D 3/04 415/208.1
2012/0168117 A1 * 7/2012 Jairazbhoy ..... B60H 1/00028 165/48.1
2013/0340972 A1 * 12/2013 Fukuda ..... F28F 17/00 165/70
2015/0198178 A1 * 7/2015 Kawasaki ..... F04D 29/422 415/119
2017/0211585 A1 * 7/2017 Hashem ..... F04D 29/4226 415/204
2018/0370325 A1 * 12/2018 Paul ..... B60H 1/00564
2019/0101131 A1 * 4/2019 Kong ..... F04D 29/442
2019/0331350 A1 * 10/2019 Choi ..... F24F 1/0011

FOREIGN PATENT DOCUMENTS

CN 203980461 U 12/2014
CN 204186644 U 3/2015
CN 104566625 A 4/2015
CN 204438446 U 7/2015
CN 204553343 U 8/2015
CN 105299859 A 2/2016
CN 205047524 U 2/2016
CN 205364342 U 7/2016
CN 105840532 A 8/2016
CN 105841245 A 8/2016
CN 205779806 U 12/2016
CN 106438405 A 2/2017
EP 1701041 A2 9/2006
EP 3059449 A1 8/2016
JP 2009-270778 A 11/2009
JP 2010117110 A * 5/2010
WO 2014038465 A1 3/2014

OTHER PUBLICATIONS

Inlet induced flow in squirrel-cage fans, by Montazerin, published 2000 (Year: 2000).*
Joint impeller/scroll sizing of squirrel cage fans using alternative nondimensional head and flow rate coefficients, by Damangir, published 2004 (Year: 2004).*
Rapidfan.com, published Nov. 2015 (Year: 2015).*
G. Hua et al., Radial fan structure and parameters, Dangdai Nongji Shiyong Xinjishu, Oct. 1987, pp. 931-936, China Agriculture Press, China.

* cited by examiner

FAN COIL UNIT

CROSS-REFERENCE TO RELATED APPLICATIONS

This application is a continuation-in-part of International Patent Application No. PCT/CN2016/098489 with an international filing date of Sep. 8, 2016, and of International Patent Application No. PCT/CN2017/077699 with an international filing date of Mar. 22, 2017, designating the United States, now pending, and further claims foreign priority benefits to Chinese Patent Application No. 201610375538.X filed May 30, 2016, to Chinese Patent Application No. 201620514736.5 filed May 30, 2016, and to Chinese Patent Application No. 201610842173.7 filed Sep. 22, 2016. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The disclosure relates to a fan coil unit.

Description of the Related Art

As shown in FIGS. 1, 2, and 3, a conventional fan coil unit includes a blower 100, a fan housing 200, and a heat exchanger 300. The blower 100 includes a volute 101, a wind wheel 102, and a motor 103. The volute 101 includes a first chamber 104, a first air inlet 105, and a first air outlet 106. The wind wheel 102 is disposed in the first chamber 104 of the volute 101. The first air inlet 105 and the first air outlet 106 communicate with the first chamber 104. The motor 103 comprises an output shaft which extends into the first chamber 104 and is connected to the wind wheel 102. The fan housing 200 comprises a second chamber 201, a second air inlet 202, and a second air outlet 203. The heat exchanger 300 is disposed in the second chamber 201 and is located between the second air inlet 202 and the second air outlet 203.

The section of the fan housing 200 is in the shape of a rectangle, and the heat exchanger 300 is vertically disposed with regard to the ground. Thus, when the air enters the fan housing 200 via the first air outlet 106 of the volute 101, turbulence is formed at the corner of the bottom of the fan housing 200, and the air produced from the blower 100 cannot reach the heat exchanger 300, reducing the work efficiency of the blower.

In addition, the design parameters of the volute 101 and the wind wheel 102 are not compatible with one another, leading to noisy operation, and further reducing the work efficiency of the blower.

SUMMARY OF THE INVENTION

In view of the above-described problems, it is one objective of the invention to provide a fan coil unit that has relatively high work efficiency and low energy consumption.

To achieve the above objectives, in accordance with one embodiment of the invention, there is provided a fan coil unit, comprising: a blower comprising a volute, a wind wheel, and a motor; a fan housing; a heat exchanger; and a hydrostatic plate. The volute comprises a first chamber, a first air inlet, and a first air outlet; the wind wheel is disposed in the first chamber of the volute; the motor comprises an output shaft which extends into the first chamber and is connected to the wind wheel; the fan housing comprises a second chamber, a second air inlet, and a second air outlet; the heat exchanger is disposed in the second chamber and is located between the second air inlet and the second air outlet; the volute further comprises a volute tongue which is close to the first air outlet; the hydrostatic plate is connected to the volute tongue; the hydrostatic plate is disposed in an inclined way and comprises an upper end and a lower end; and the upper end of the hydrostatic plate is connected to the volute tongue which is close to the first air outlet, and the lower end of the hydrostatic plate extends towards the heat exchanger.

In a class of this embodiment, an angle a of inclination of the hydrostatic plate is $75° > a > 30°$; parameters of the volute fulfill the following formula: $Hscmax > (Hex1 + Hex2)$; $Hex1/D2 \geq 0.112$; $Hex2/D2 \leq 0.685$, Hscmax represents a vertical distance between a center of the wind wheel and a highest point of the volute; where Hex2 represents a vertical distance between a top of the second air outlet and a top point of the volute tongue; Hex1 represents a vertical distance between the top point of the volute tongue and the center of the wind wheel; and D2 represents an outer diameter of the wind wheel.

In a class of this embodiment, two ends of the hydrostatic plate are provided with hydrostatic side plates close to the first air outlet; the parameters of the volute fulfill the following formula: $1.65 \geq 2*b2/D2 \geq 1.45$, where b2 represents an effective width of the wind wheel, and D2 represents an outer diameter of the wind wheel.

In a class of this embodiment, a relation between the effective width of the wind wheel and a width of the volute fulfills the following formula: $0.98 \geq 2*b2/B2 \geq 0.845$, where B2 represents the width of the volute.

In a class of this embodiment, a relation between an arc radius of the first air inlet of the volute and the outer diameter of the wind wheel fulfills the following formula: $0 \leq r/D2 \leq 0.069$, where r represents the arc radius of the first air inlet.

In a class of this embodiment, the hydrostatic side plates are disposed at two sides of the first air outlet, respectively; bottom ends of the hydrostatic side plates are connected to two side ends of the hydrostatic plate, and the hydrostatic side plates are vertically disposed with regard to the ground.

In a class of this embodiment, the hydrostatic side plates extend from the first air outlet to a middle section of the hydrostatic plate, and the hydrostatic side plates and the hydrostatic plate are both disposed in the second chamber.

In a class of this embodiment, the hydrostatic plate is a flat slab, the second air inlet is located at an upper part of one end of the fan housing, and the second air outlet is located at an upper part of the other end of the fan housing.

In a class of this embodiment, the fan housing comprises a top plate, a bottom plate, a rear plate, and side plate; the bottom plate comprises a baseplate and a guide plate connected to the baseplate; the guide plate inclines upwards; an upper end of the guide plate is connected to a bottom of the second air outlet; the top plate, the baseplate, the rear plate, and the side plate form a rectangular structure; and the second air outlet is disposed at a top of the rear plate.

In a class of this embodiment, the heat exchanger is disposed vertically or slantly in the second chamber; two ends of the heat exchanger are connected to the top plate and the bottom plate, respectively; the lower end of the hydrostatic plate is connected to the bottom plate of the fan housing.

In a class of this embodiment, the hydrostatic plate comprises a plurality of through holes, a third chamber is disposed below the hydrostatic plate, and third chamber is filled with damping material.

In a class of this embodiment, the fan housing comprises a top plate, a bottom plate, a rear plate, and side plate; the second air outlet is disposed on the rear plate; the bottom plate comprises the hydrostatic plate, a middle plate, and a guide plate which are connected successively; the lower end of the hydrostatic plate is connected to the middle plate of the fan housing; the guide plate inclines upwards; an upper end of the guide plate is connected to a bottom of the second air outlet; and the second air outlet is enclosed by the side plate, the top plate, and the upper end of the guide plate.

In a class of this embodiment, the middle plate is parallel to the top plate; the heat exchanger is disposed vertically or slantly in the second chamber; two ends of the heat exchanger are connected to the top plate and the middle plate, respectively.

In a class of this embodiment, the hydrostatic plate is made of damping material.

In a class of this embodiment, the blower comprises two volutes, two wind wheels, and one motor; two second air inlets are disposed at one side of the fan housing; the two volutes are respectively disposed at two sides of the motor; the two wind wheels are disposed in the two volutes, respectively; two shaft extensions of the motor are connected to the two wind wheels, respectively; two first air outlets of the two volutes communicate with the two second air inlets of the fan housing, respectively.

In a class of this embodiment, the hydrostatic plate is a curved plate, the heat exchanger is slantly disposed, and the hydrostatic plate and the heat exchanger tilt towards a same direction.

Advantages of the fan coil unit of the disclosure are summarized as follows:

1. The volute comprises a volute tongue which is close to the first air outlet; the hydrostatic plate is connected to the volute tongue; the hydrostatic plate is disposed in an inclined way and comprises an upper end and a lower end; and the upper end of the hydrostatic plate is connected to the volute tongue which is close to the first air outlet, and the lower end of the hydrostatic plate extends towards the heat exchanger. This, the air is directly blown from the blower to the heat exchanger, preventing the vortex, improving the efficiency, reducing the pressure loss of the air passing through the heat exchanger, and decreasing the energy consumption.

2. Experiments show that, when the angle a of inclination of the hydrostatic plate is a>30°, and the parameters of the volute fulfill the following formula: Hscmax>(Hex1+Hex2), Hex1/D2≥0.112, and Hex2/D2≤0.685, the energy-saving effect is ideal, and the work efficiency is higher by 5%-10% than traditional coil fans.

3. The bottom plate comprises the hydrostatic plate, a middle plate, and a guide plate which are connected successively; the lower end of the hydrostatic plate is connected to the middle plate of the fan housing; the guide plate inclines upwards; an upper end of the guide plate is connected to the second air outlet. This is conducive to simplifying the structure and saving the production cost.

4. The hydrostatic plate is made of damping material, which can effectively reduce the noise.

5. The fan housing comprises a top plate, a bottom plate, a front plate, a rear plate, and side plate. The top plate, the baseplate, the front plate, the rear plate, and the side plate form a parallelogram structure. The second air outlet is disposed at the top of the rear plate. The second air inlet is disposed at the top of the front plate. The heat exchanger is disposed vertically or slantly in the second chamber; two ends of the heat exchanger are connected to the top plate and the bottom plate, respectively; the lower end of the hydrostatic plate is connected to the bottom plate of the fan housing. The hydrostatic plate comprises a plurality of through holes, a third chamber is disposed below the hydrostatic plate, and third chamber is filled with damping material. This can effectively reduce the noise.

6. The hydrostatic plate is a curved plate, the heat exchanger is slantly disposed, and the hydrostatic plate and the heat exchanger tilt towards the same direction. The arrangement improves the work efficiency by 10% in contrast to that in the absence of the hydrostatic plate.

7. Two ends of the hydrostatic plate are provided with hydrostatic side plates close to the first air outlet; the parameters of the volute fulfill the following formula: 1.65≥2*b2/D2≥1.45, where b2 represents an effective width of the wind wheel, and D2 represents an outer diameter of the wind wheel. This effectively improves the operating efficiency of the motor and the blower.

8. The relation between the effective width of the wind wheel and a width of the volute fulfills the following formula: 0.98≥2*b2/B2≥0.845, where B2 represents the width of the volute. This further improves the operating efficiency of the motor and the blower.

9. The relation between an arc radius of the first air inlet of the volute and the outer diameter of the wind wheel fulfills the following formula: 0<r/D2≤0.069, where r represents the arc radius of the first air inlet. This further improves the operating efficiency of the motor and the blower.

10. The hydrostatic side plates are disposed at two sides of the first air outlet, respectively; bottom ends of the hydrostatic side plates are connected to two side ends of the hydrostatic plate, and the hydrostatic side plates are vertically disposed with regard to the ground. The hydrostatic side plates extend from the first air outlet to a middle section of the hydrostatic plate, and the hydrostatic side plates and the hydrostatic plate are both disposed in the second chamber. The hydrostatic plate is made of damping material, which can effectively reduce the noise.

BRIEF DESCRIPTION OF THE DRAWINGS

The invention is described hereinbelow with reference to the accompanying drawings, in which.

DETAILED DESCRIPTION OF THE EMBODIMENTS

Figure 1:
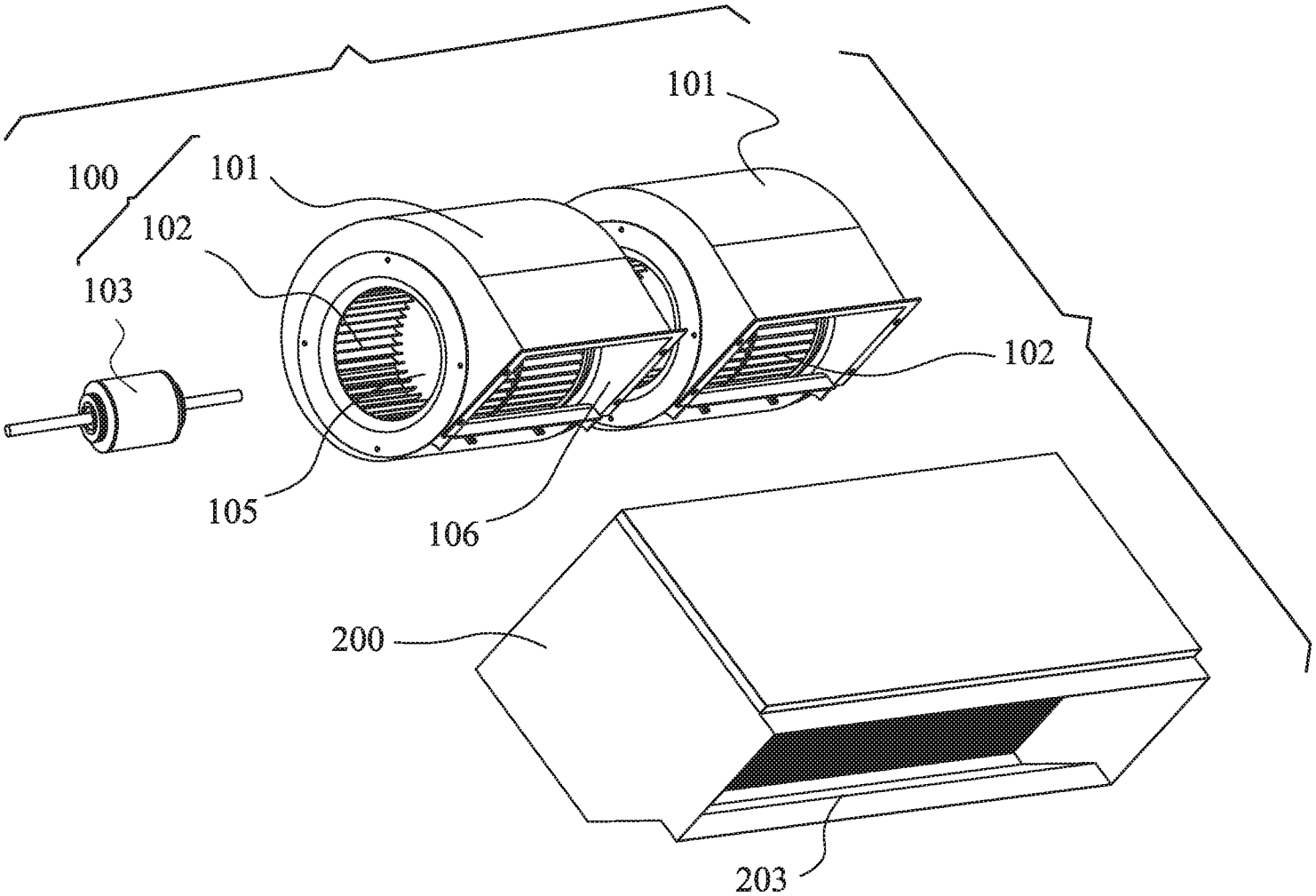
FIG. 1 (Prior art)
FIG. 1 is an exploded view of a fan coil unit in the prior art.
Figure 2:
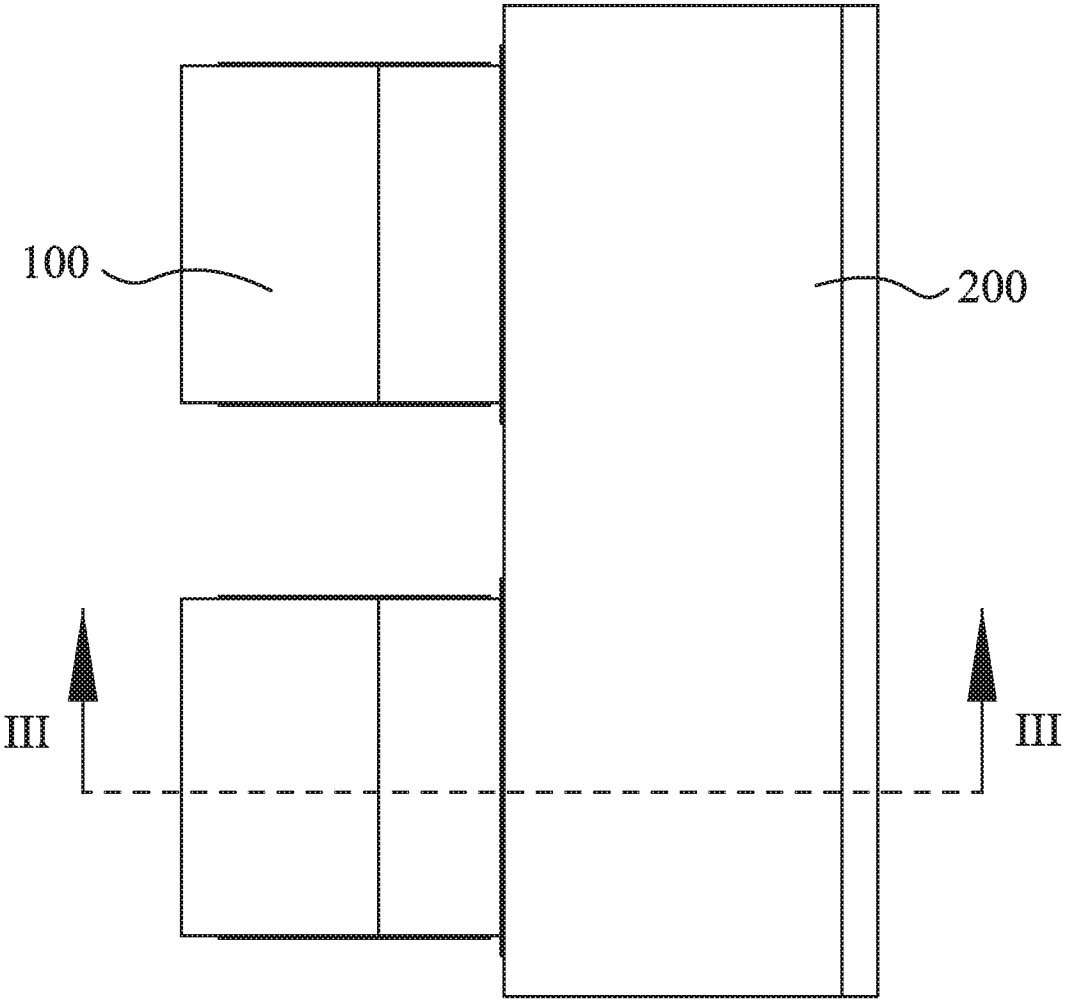
FIG. 2 (Prior art)
FIG. 2 is a top view of a fan coil unit in the prior art.
Figure 3:
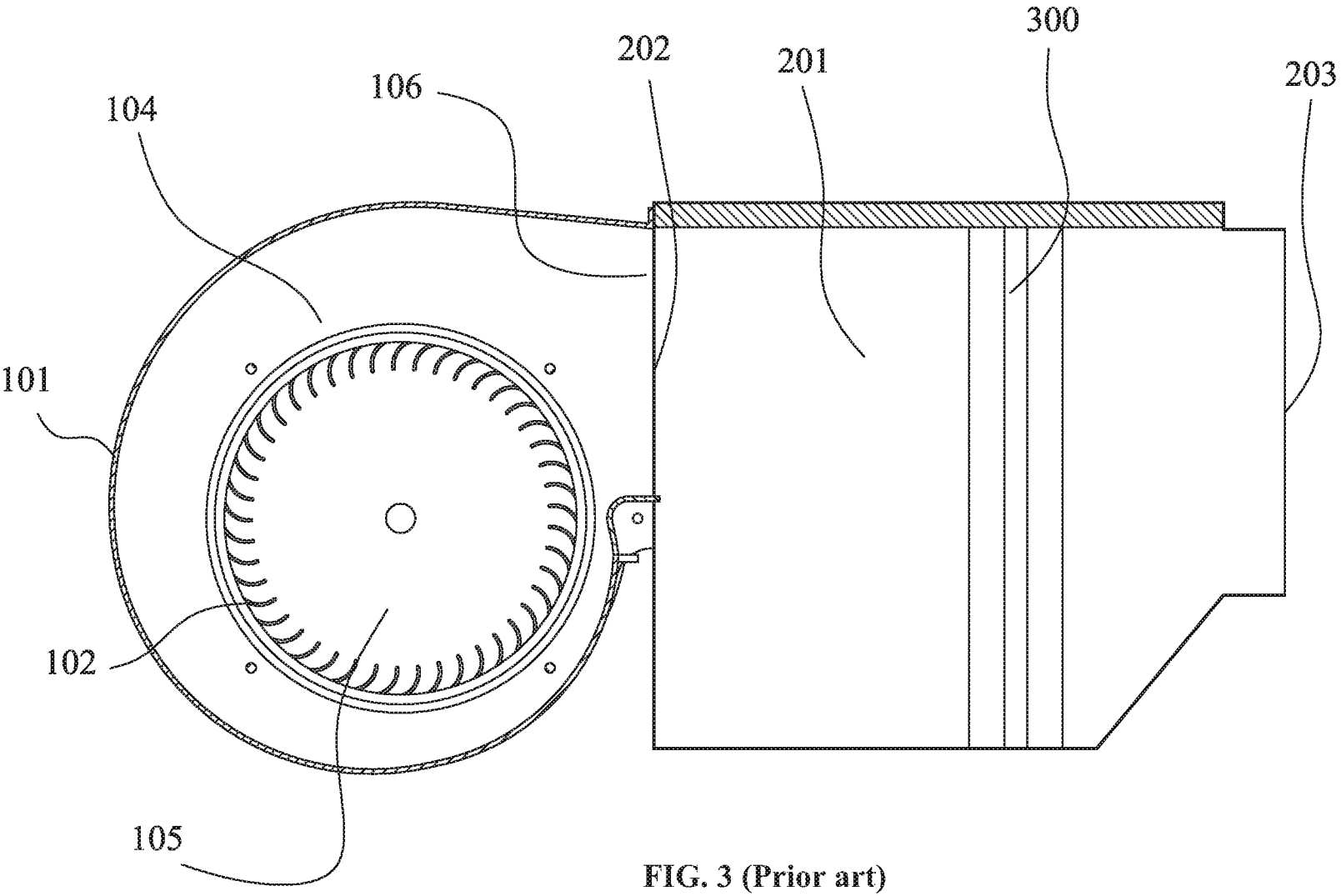
FIG. 3 (Prior art)
FIG. 3 is a sectional view taken from line III-III in FIG. 2.
Figure 4:
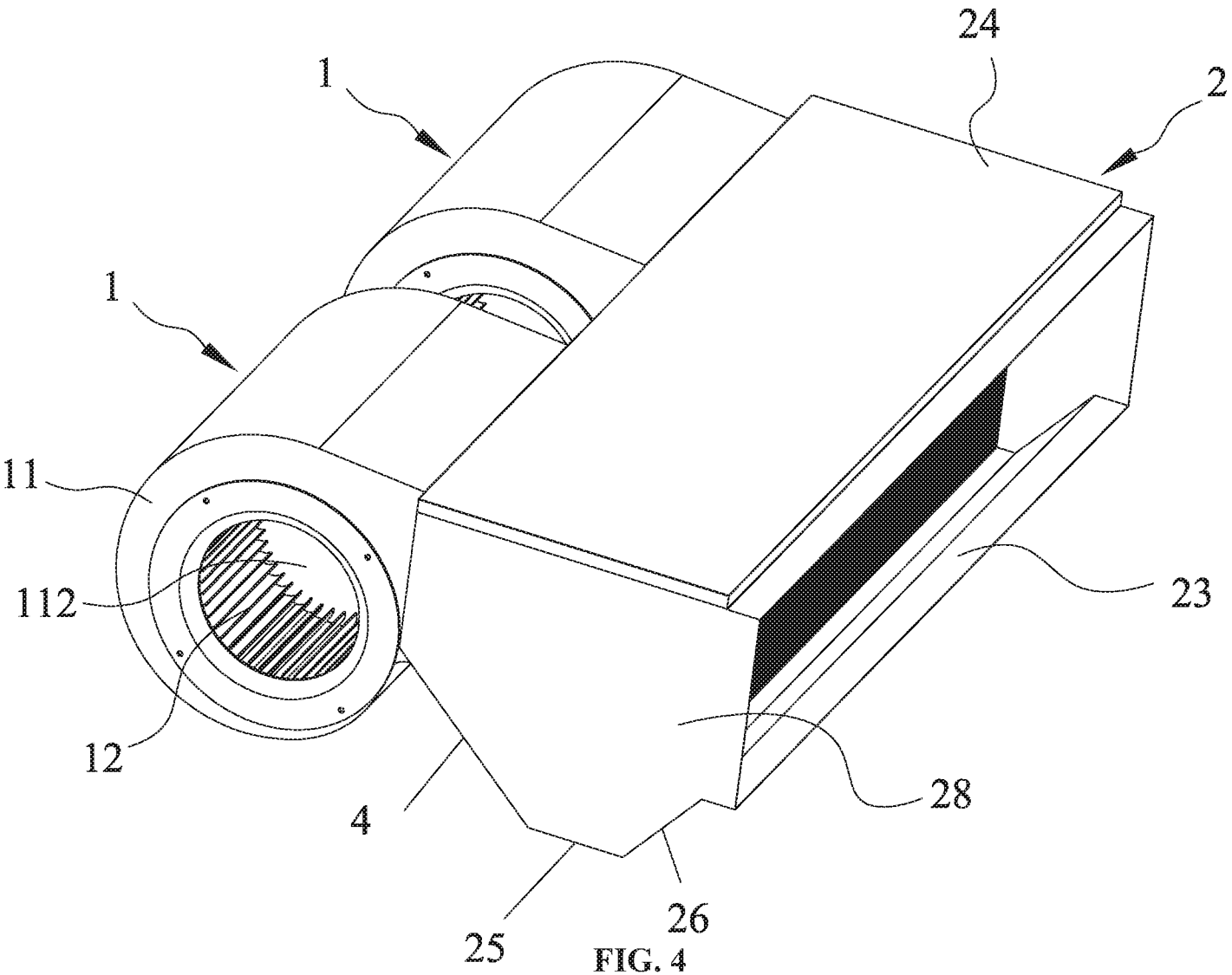
FIG. 4 is a stereogram of a fan coil unit in Example 1 of the disclosure.
Figure 5:
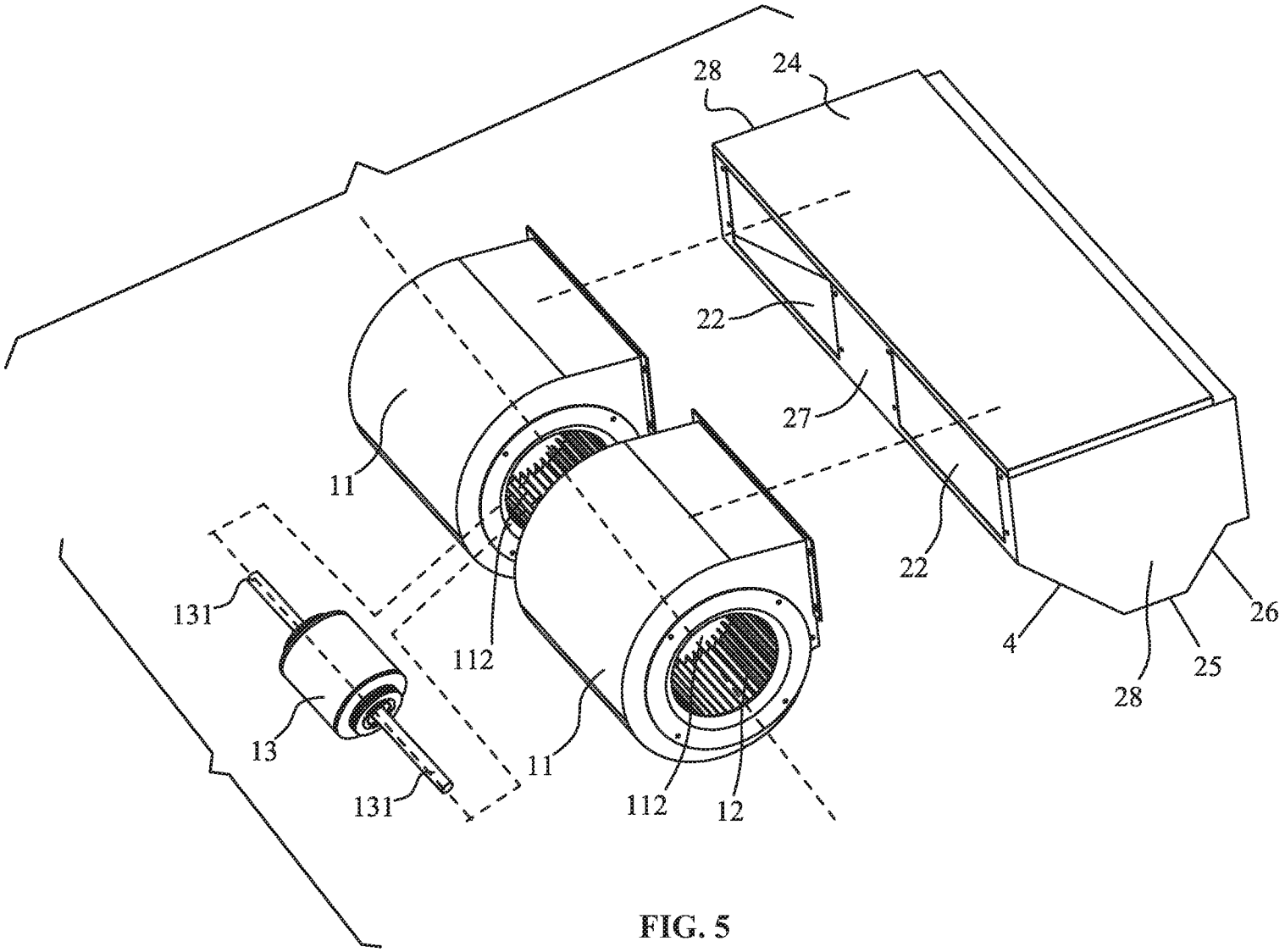
FIG. 5 is an exploded view of a fan coil unit in Example 1 of the disclosure.
Figure 6:
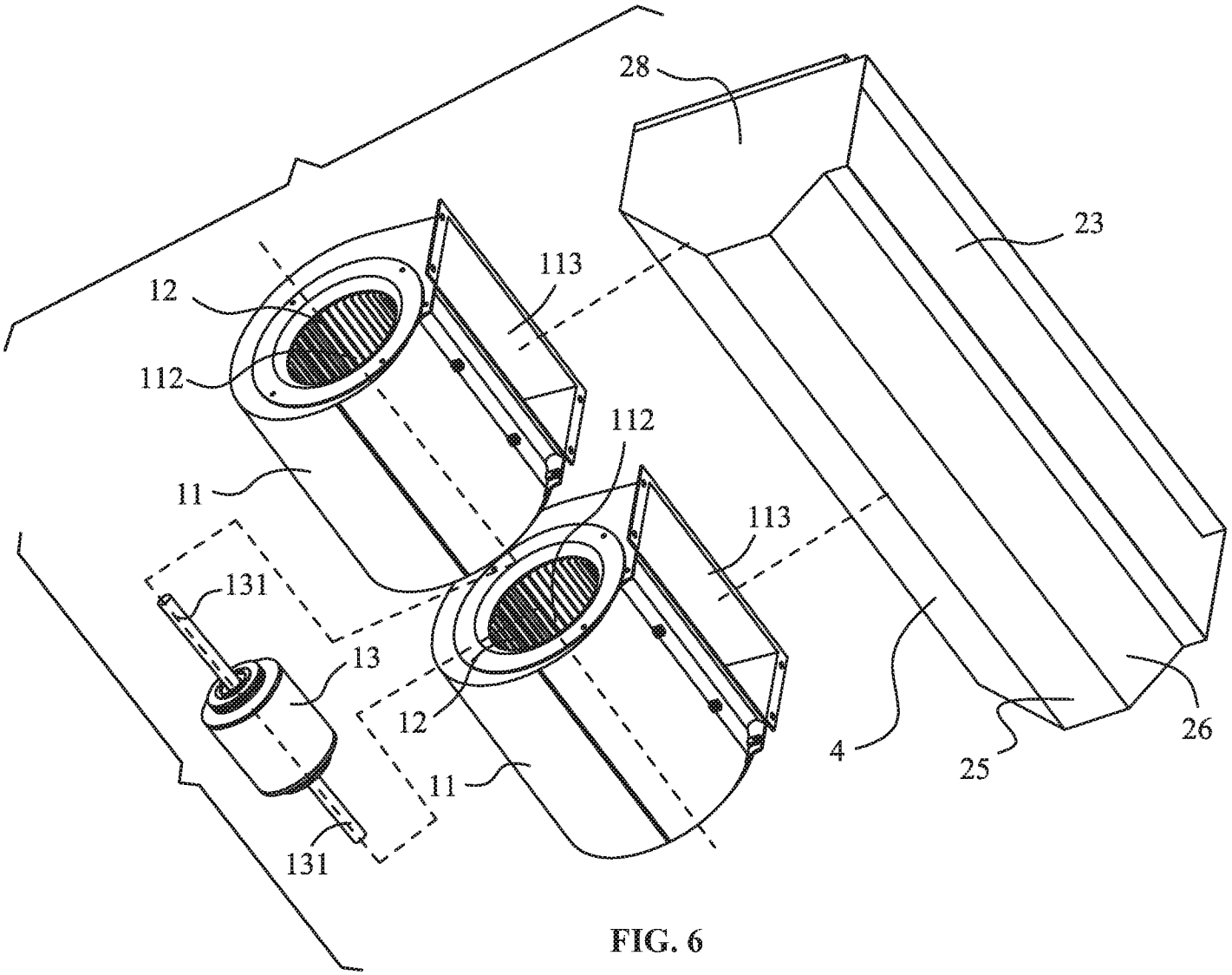
FIG. 6 is another exploded view of a fan coil unit in Example 1 of the disclosure.
Figure 7:
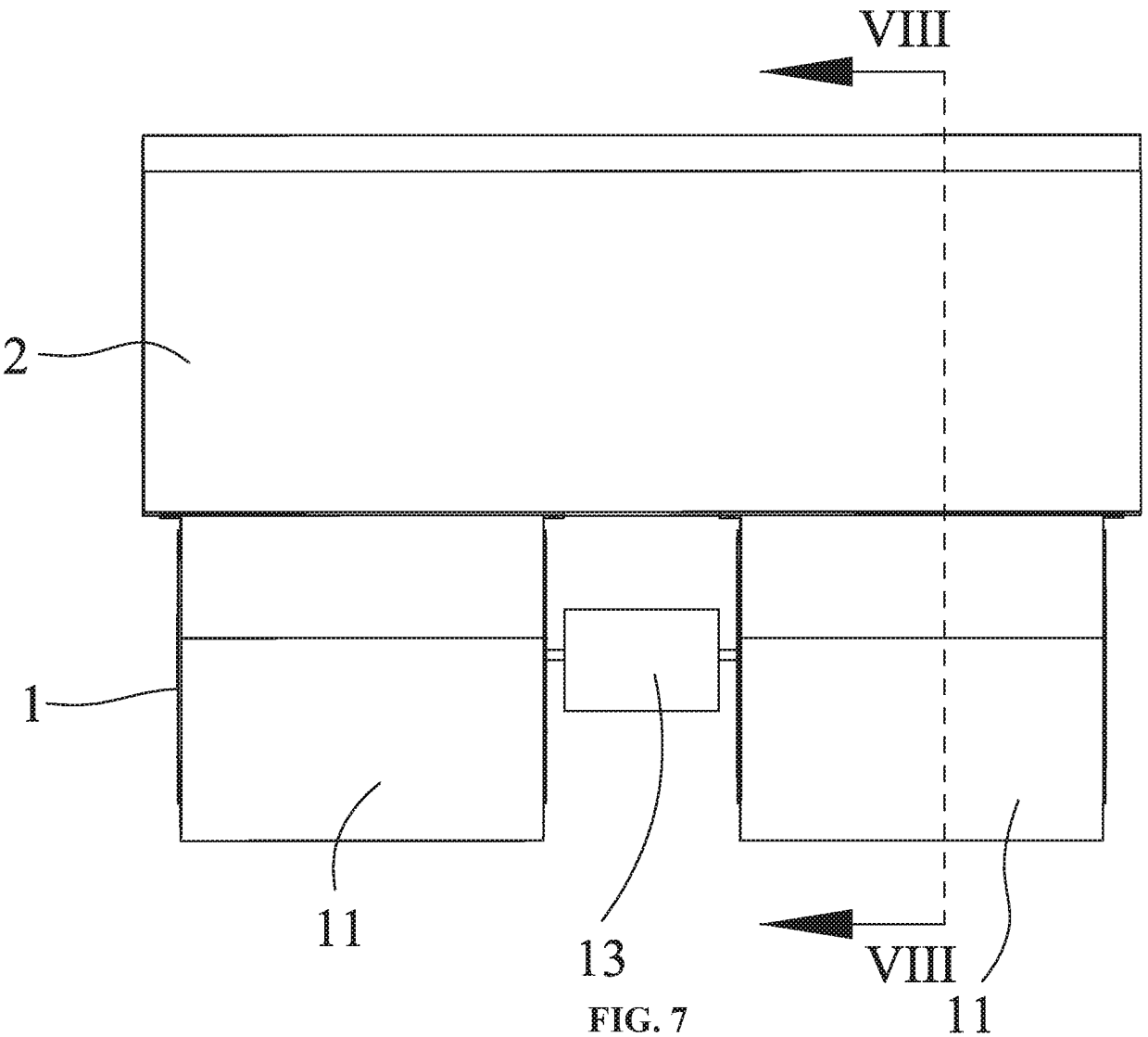
FIG. 7 is a top view of a fan coil unit in Example 1 of the disclosure.
Figure 8:
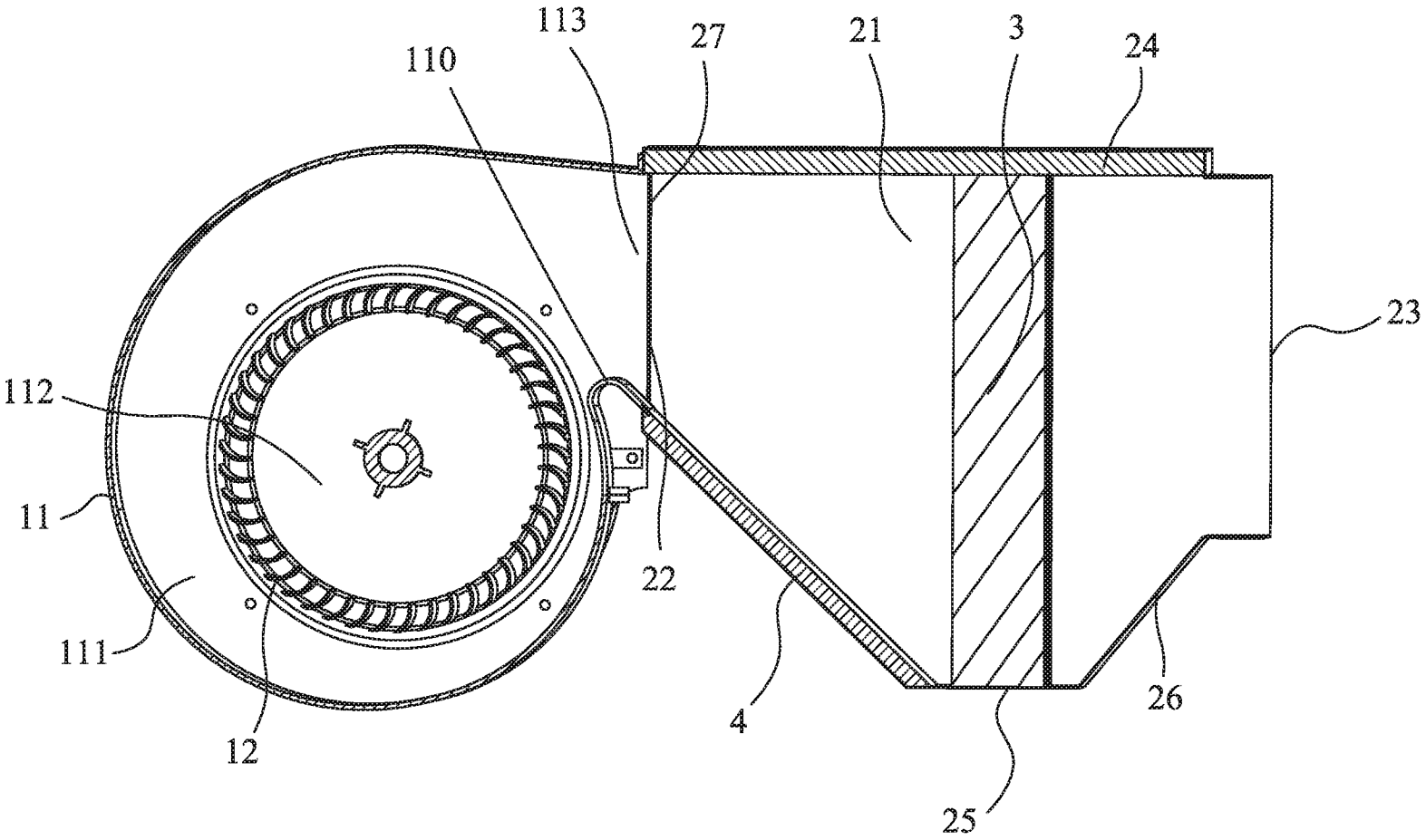
FIG. 8 is a sectional view taken from line VIII-VIII in FIG. 7.

For further illustrating the invention, experiments detailing a fan coil unit are described below.

Example 1

As shown in FIGS. 4-9, a fan coil unit, comprises: a blower 1 comprising a volute 11, a wind wheel 12, and a motor 13; a fan housing 2; a heat exchanger 3; and a hydrostatic plate 4. The volute 11 comprises a first chamber 111, a first air inlet 112, and a first air outlet 113; the wind wheel 12 is disposed in the first chamber 111 of the volute 11; the motor 13 comprises an output shaft 131 which extends into the first chamber 111 and is connected to the wind wheel 12; the fan housing 2 comprises a second chamber 21, a second air inlet 22, and a second air outlet 23; the heat exchanger 3 is disposed in the second chamber 21 and is located between the second air inlet 22 and the second air outlet 23; the volute 11 further comprises a volute tongue which is close to the first air outlet 113; the hydrostatic plate 4 is connected to the volute tongue; the hydrostatic plate 4 is disposed in an inclined way and comprises an upper end and a lower end; and the upper end of the hydrostatic plate 4 is connected to the volute tongue which is close to the first air outlet 113, and the lower end of the hydrostatic plate 4 extends towards the heat exchanger 3.

The hydrostatic plate 4 is a flat slab, the second air inlet 22 is located at an upper part of one end of the fan housing 2, and the second air outlet 23 is located at an upper part of the other end of the fan housing 2.

The fan housing 2 comprises a top plate 24, a bottom plate, a rear plate 27, and side plate 28. The top plate 24, the bottom plate, the rear plate 27, and the side plate 28 enclose the second chamber 21. The second air outlet 22 is disposed on the rear plate 27; the bottom plate comprises the hydrostatic plate 4, a middle plate 25, and a guide plate 26 which are connected successively; the lower end of the hydrostatic plate 4 is connected to the middle plate 25 of the fan housing 2; the guide plate 26 inclines upwards; an upper end of the guide plate 26 is connected to a bottom of the second air outlet 23; and the second air outlet 23 is enclosed by the side plate 28, the top plate 24, and the upper end of the guide plate 26. The middle plate 25 is parallel to the top plate 24; the heat exchanger 3 is disposed vertically or slantly in the second chamber; two ends of the heat exchanger 3 are connected to the top plate 24 and the middle plate 25, respectively. The hydrostatic plate 4 is made of damping material.

The blower 1 comprises two volutes 11, two wind wheels 12, and one motor 13; two second air inlets 22 are disposed at one side of the fan housing 2; the two volutes 11 are respectively disposed at two sides of the motor 13; the two wind wheels 12 are disposed in the two volutes 11, respectively; two shaft extensions of the motor 13 are connected to the two wind wheels 12, respectively; two first air outlets 113 of the two volutes 11 communicate with the two second air inlets 22 of the fan housing 2, respectively.

Figure 9:
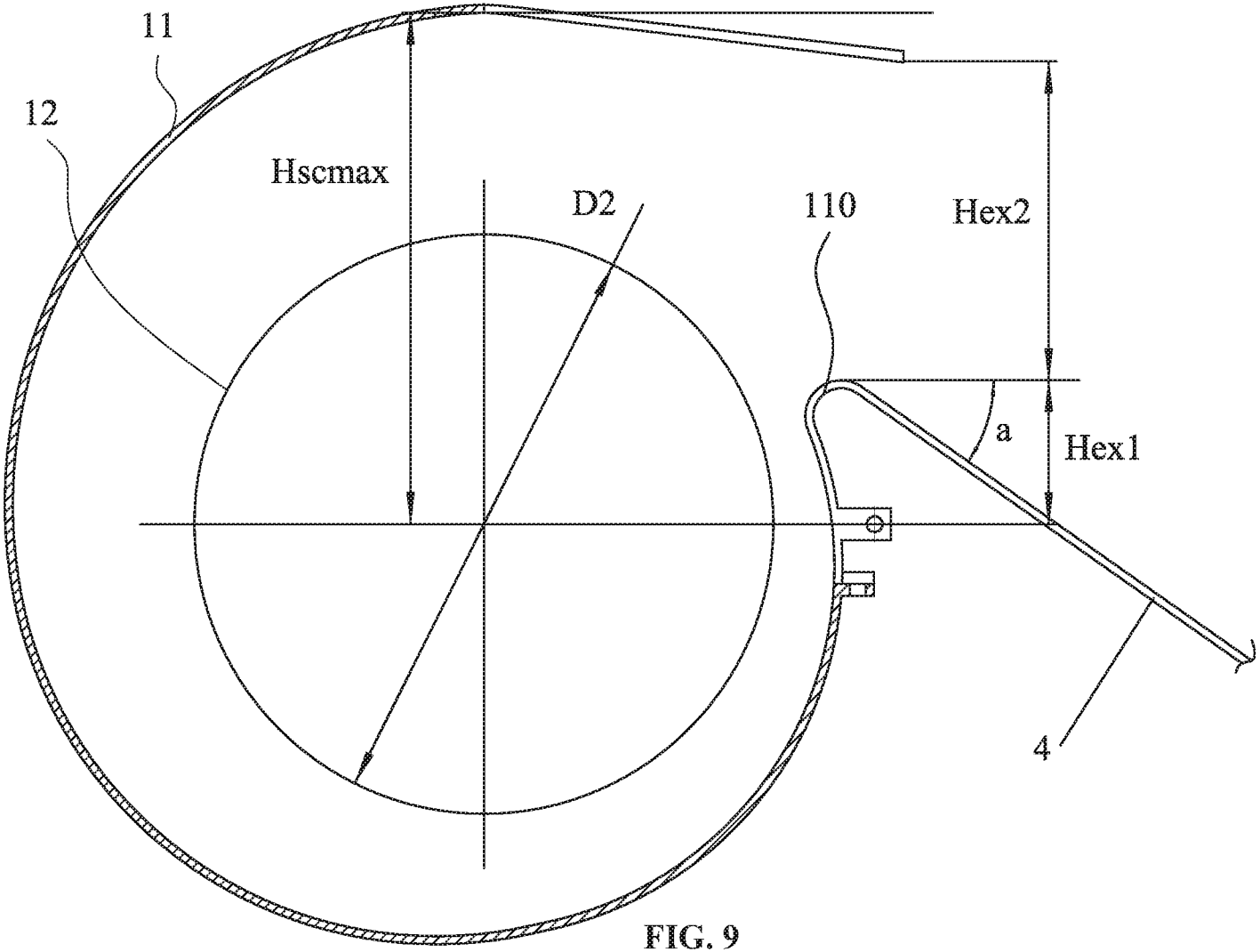
FIG. 9 illustrates design parameters of a fan coil unit of the disclosure.
Figure 10:
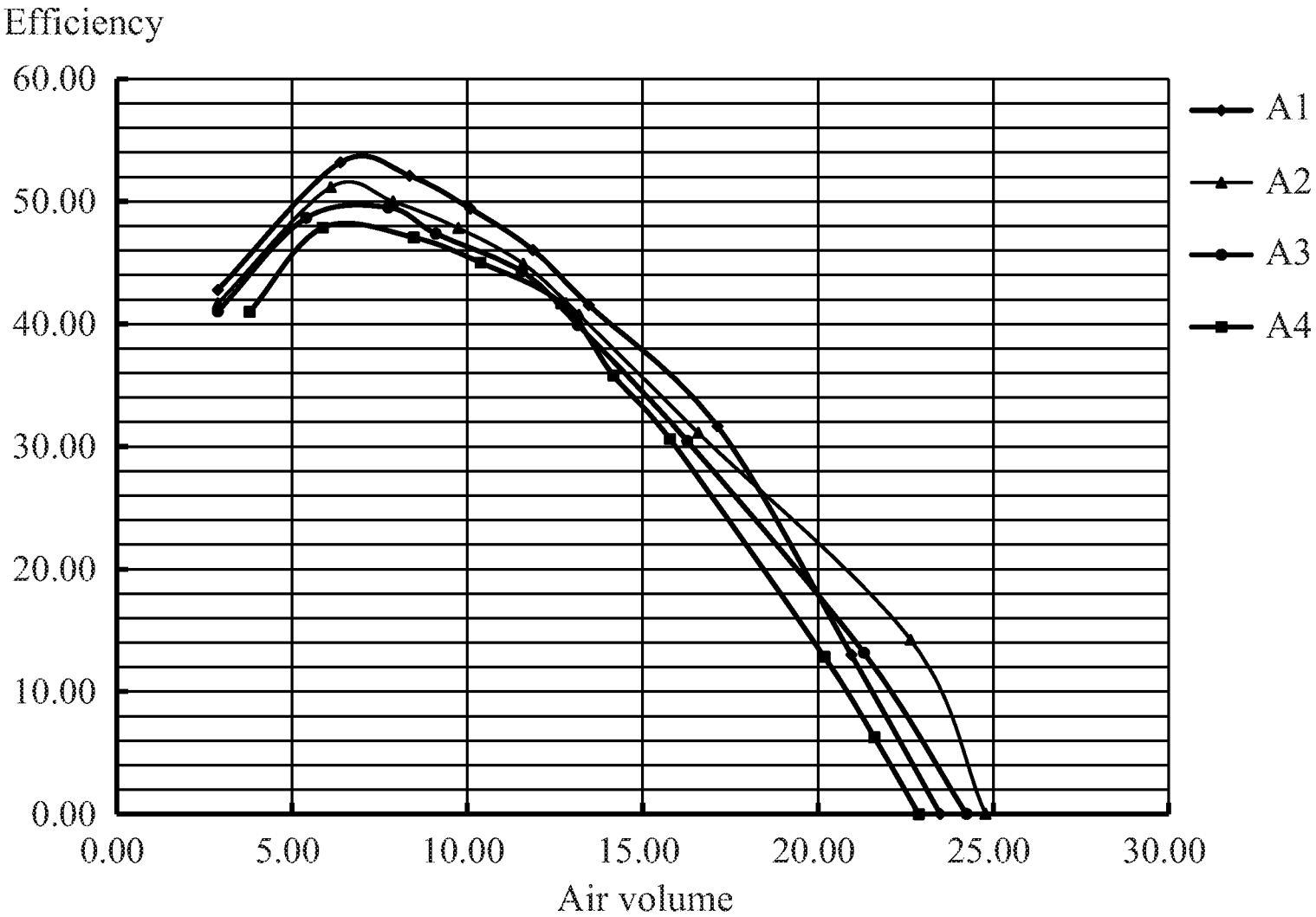
FIG. 10 is a comparison diagram of experimental results of the disclosure.

As shown in FIG. 9, the angle a of inclination of the hydrostatic plate 4 is 75°>a>30°; the parameters of the volute 11 fulfill the following formula: Hscmax>(Hex1+Hex2); Hex1/D2≥0.112; Hex2/D2≤0.685, Hscmax represents a vertical distance between a center of the wind wheel 12 and a highest point of the volute; where Hex2 represents a vertical distance between a top of the second air outlet and a top point of the volute tongue; Hex1 represents a vertical distance between the top point of the volute tongue and the center of the wind wheel 12; and D2 represents an outer diameter of the wind wheel 12. Tests show that, the results are ideal when a=30°, a=35°, a=40°, a=45°, a=50°, a=60°, and a=75°. As shown in FIG. 10, when the angle a of inclination is 43°, based on the testing conditions in Table 1, the experimental results are listed in Tables 2, 3, and 4. Table 5 lists the experimental result in the presence of the hydrostatic plate. The experimental results are shown in four curves in FIG. 10, that is, Curve A1, Curve A2, Curve A3, Curve A4. Curve A1 fulfills the following conditions: Hscmax>(Hex1+Hex2); Hex1/D2≥0.055; Hex2/D2≤0.883. Curve A2 and Curve A3 are in the critical conditions. Curve A1 has the highest efficiency when the output wind is less than 10 units. Curve A4 is the experimental result in the presence of the hydrostatic plate in Table 5, with the lowest efficiency.

TABLE 1

| | | |
|---|---|---|
| Number of revolutions | $n_n$ (rpm) = | 815.00 |
| Normal atmosphere | Pan (hPa) = | 1013.00 |
| Standard temperature | tan (° C.) = | 25.00 |
| Air density | ρa (kg/m$^3$) = | 1.1767 |

TABLE 2

Testing conditions I:
$Hsc_{max} > (Hex_1 + Hex_2 + 14)$; a = 43°
$Hex_1/D_2 = 0.248$;
$Hex_2/D_2 = 0.549$:

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1408.98 | 23.48 | 0.02 | 35.38 | 3.98 | 9.31 | 9.33 | 0.02 | 10.32 |
| 1256.99 | 20.95 | 11.21 | 30.10 | 3.55 | 7.41 | 18.62 | 13.00 | 21.60 |
| 1027.96 | 17.13 | 26.01 | 23.46 | 2.90 | 4.95 | 30.96 | 31.66 | 37.69 |
| 807.73 | 13.46 | 31.73 | 17.14 | 2.28 | 3.06 | 34.79 | 41.55 | 45.56 |
| 712.25 | 11.87 | 34.18 | 14.69 | 2.01 | 2.38 | 36.56 | 46.04 | 49.25 |
| 604.96 | 10.08 | 36.77 | 12.50 | 1.71 | 1.72 | 38.49 | 49.42 | 51.73 |
| 501.25 | 8.35 | 39.20 | 10.48 | 1.41 | 1.18 | 40.38 | 52.09 | 53.66 |
| 382.78 | 6.38 | 41.14 | 8.23 | 1.08 | 0.69 | 41.83 | 53.18 | 54.07 |
| 173.01 | 2.88 | 42.38 | 4.76 | 0.49 | 0.14 | 42.52 | 42.78 | 42.92 |

TABLE 3

Testing conditions II:
$Hsc_{max} = (Hex_1 + Hex_2)$; a = 43°
$Hex_1/D_2 = 0.248$;
$Hex_2/D_2 = 0.549$:

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1486.26 | 24.77 | 0.02 | 38.05 | 4.20 | 10.36 | 10.38 | 0.02 | 11.26 |
| 1358.33 | 22.64 | 12.72 | 33.73 | 3.83 | 8.65 | 21.37 | 14.23 | 23.91 |
| 995.11 | 16.59 | 24.97 | 22.18 | 2.81 | 4.64 | 29.61 | 31.12 | 36.91 |
| 791.21 | 13.19 | 31.62 | 17.05 | 2.23 | 2.94 | 34.55 | 40.76 | 44.54 |
| 695.71 | 11.60 | 34.65 | 14.91 | 1.96 | 2.27 | 36.92 | 44.92 | 47.86 |
| 584.36 | 9.74 | 37.01 | 12.56 | 1.65 | 1.60 | 38.61 | 47.82 | 49.89 |
| 472.83 | 7.88 | 39.17 | 10.29 | 1.33 | 1.05 | 40.22 | 49.99 | 51.33 |
| 366.29 | 6.10 | 41.31 | 8.22 | 1.03 | 0.63 | 41.94 | 51.16 | 51.94 |
| 173.39 | 2.89 | 42.74 | 4.94 | 0.49 | 0.14 | 42.88 | 41.69 | 41.83 |

TABLE 4

Testing conditions III:
$Hsc_{max} = (Hex_1 + Hex_2 + 14)$; a = 43°
$Hex_1/D_2 = 0.112$:
$Hex_2/D_2 = 0.685$:

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1453.82 | 24.23 | 0.02 | 37.97 | 4.10 | 9.91 | 9.93 | 0.02 | 10.56 |
| 1278.48 | 21.31 | 11.64 | 31.38 | 3.61 | 7.66 | 19.31 | 13.17 | 21.85 |
| 976.20 | 16.27 | 24.94 | 22.21 | 2.76 | 4.47 | 29.41 | 30.45 | 35.91 |
| 788.84 | 13.15 | 32.22 | 17.68 | 2.23 | 2.92 | 35.14 | 39.93 | 43.54 |
| 693.25 | 11.55 | 34.77 | 15.12 | 1.96 | 2.25 | 37.02 | 44.28 | 47.15 |
| 545.88 | 9.10 | 35.75 | 11.44 | 1.54 | 1.40 | 37.15 | 47.37 | 49.22 |
| 464.78 | 7.75 | 38.93 | 10.15 | 1.31 | 1.01 | 39.94 | 49.51 | 50.80 |
| 324.00 | 5.40 | 40.41 | 7.47 | 0.91 | 0.49 | 40.91 | 48.66 | 49.25 |
| 173.20 | 2.89 | 41.34 | 4.85 | 0.49 | 0.14 | 41.48 | 41.03 | 41.17 |

TABLE 5

Testing conditions IV:
No hydrostatic plate
Hscmax = (Hex1 + Hex2 + 14);
$Hex_1/D_2$ = 0.248:
$Hex_2/D_2$ = 0.549:

| | | | | | Air outlet of volute | | | Blower | |
|---|---|---|---|---|---|---|---|---|---|
| Rotation speed n (rpm) | Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 815.00 | 1372.25 | 22.87 | 0.01 | 27.11 | 4.19 | 10.32 | 10.33 | 0.01 | 11.45 |
| 815.00 | 1296.16 | 21.60 | 5.41 | 32.41 | 3.97 | 9.25 | 14.66 | 6.28 | 17.03 |
| 815.00 | 1211.07 | 20.18 | 10.91 | 29.04 | 3.59 | 7.60 | 18.51 | 12.83 | 21.76 |
| 815.00 | 946.83 | 15.78 | 24.54 | 21.09 | 2.77 | 4.51 | 29.05 | 30.61 | 36.23 |
| 815.00 | 849.84 | 14.16 | 28.22 | 18.61 | 2.48 | 3.63 | 31.85 | 35.79 | 40.40 |
| 815.00 | 760.94 | 12.68 | 31.66 | 16.05 | 2.22 | 2.91 | 34.57 | 41.70 | 45.53 |
| 815.00 | 622.65 | 10.38 | 33.60 | 12.91 | 1.82 | 1.95 | 35.55 | 45.01 | 47.62 |
| 815.00 | 508.48 | 8.47 | 36.34 | 10.91 | 1.49 | 1.30 | 37.64 | 47.06 | 48.74 |
| 815.00 | 352.32 | 5.87 | 43.60 | 8.91 | 1.03 | 0.62 | 43.77 | 47.86 | 48.05 |
| 815.00 | 227.83 | 3.80 | 49.69 | 7.67 | 0.67 | 0.26 | 49.95 | 41.00 | 41.22 |

Example 2

Figure 11:
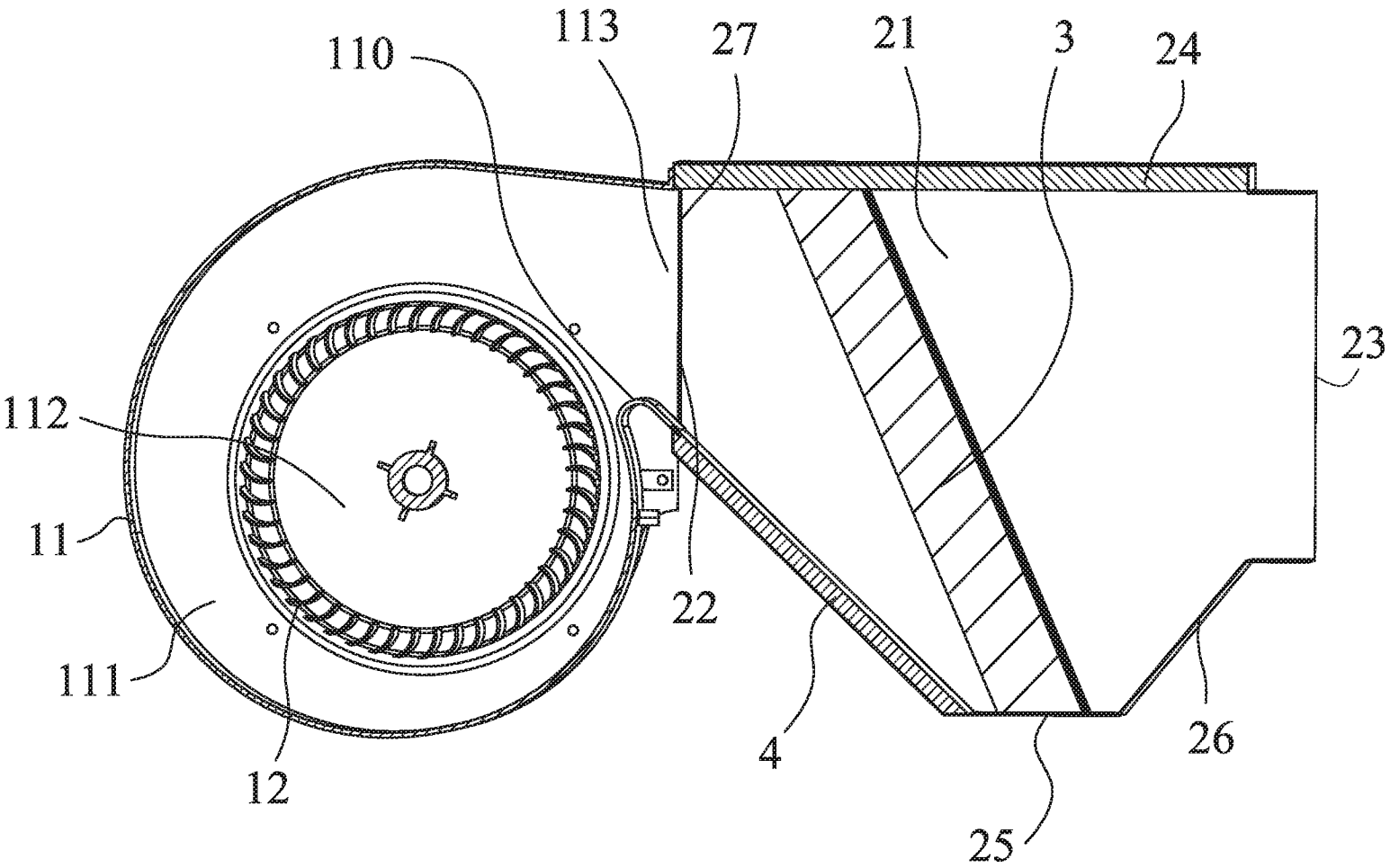
FIG. 11 is a sectional view of a fan coil unit in Example 2 of the disclosure.

As shown in FIG. 11, the fan coil unit in this example is basically the same as that in Example 1 except that: the heat exchanger 3 is slantly disposed, the upper end and the lower end of the heat exchanger 3 are connected to the top plate 24 and the middle plate 25, respectively. The heat exchanger 3 is no longer vertical to the top plate 24 and the middle plate 25.

Example 3

Figure 12:
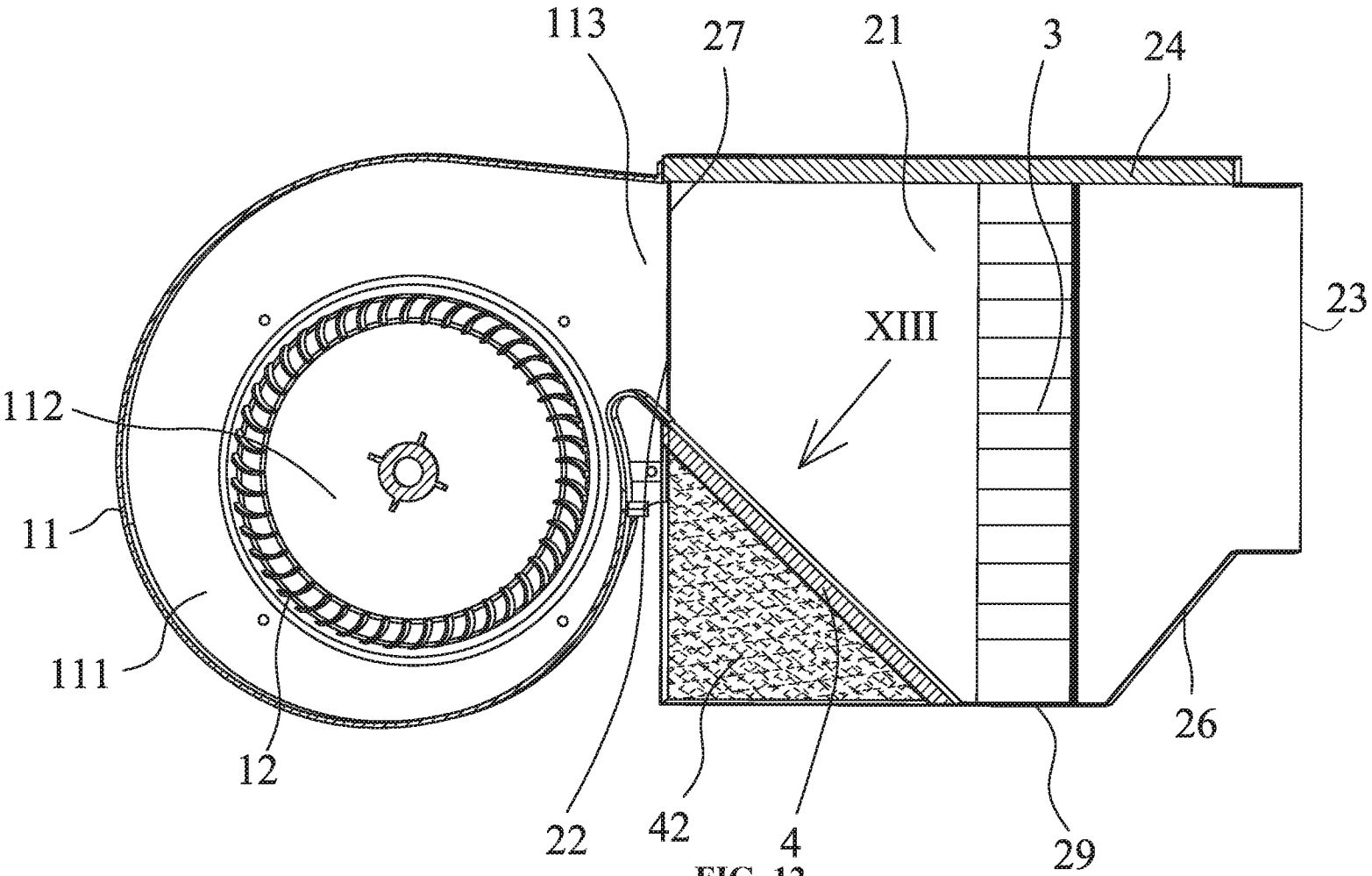
FIG. 12 is a sectional view of a fan coil unit in Example 3 of the disclosure.
Figure 13:
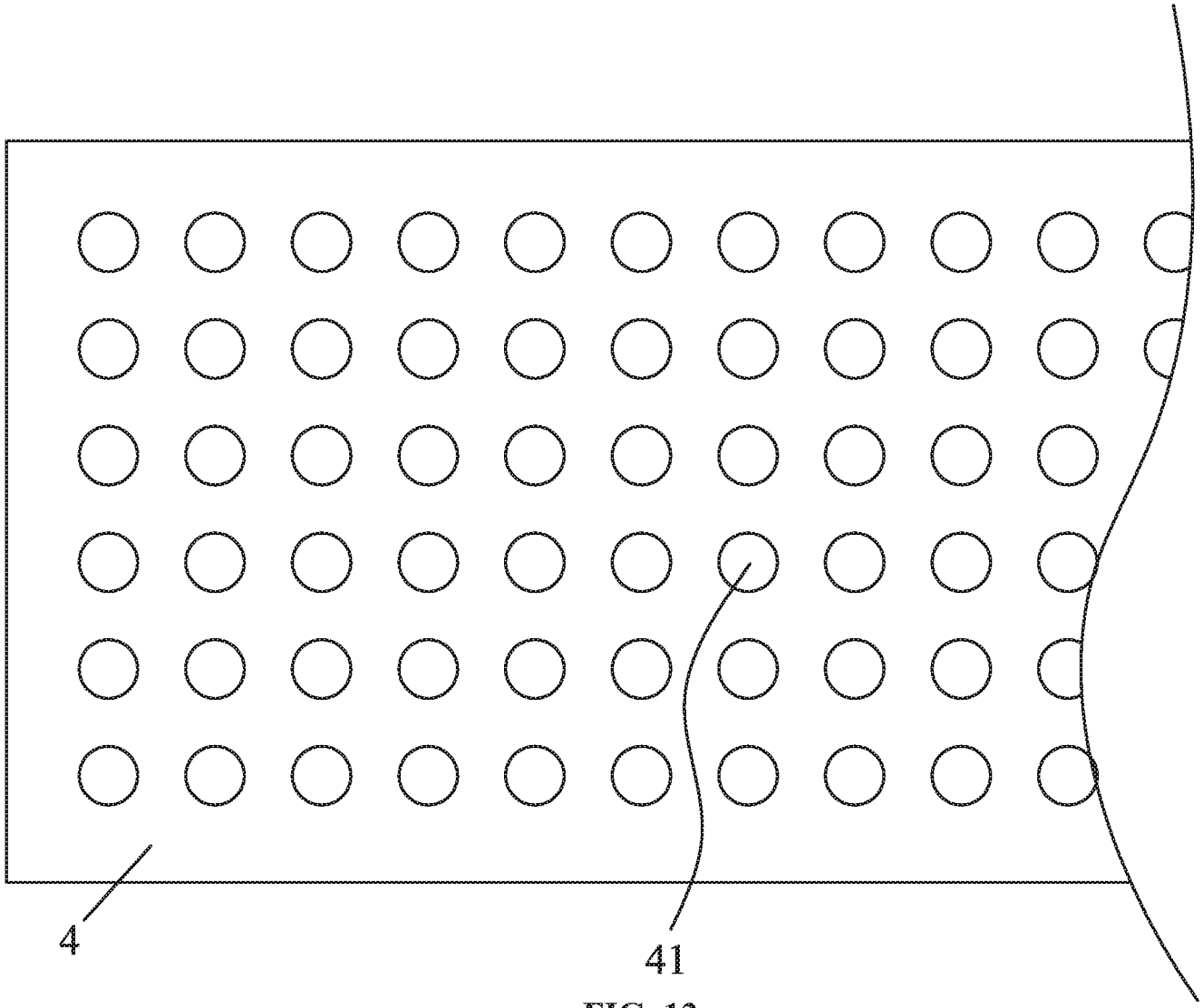
FIG. 13 is a perspective view from direction XIII in FIG. 12.
Figure 14:
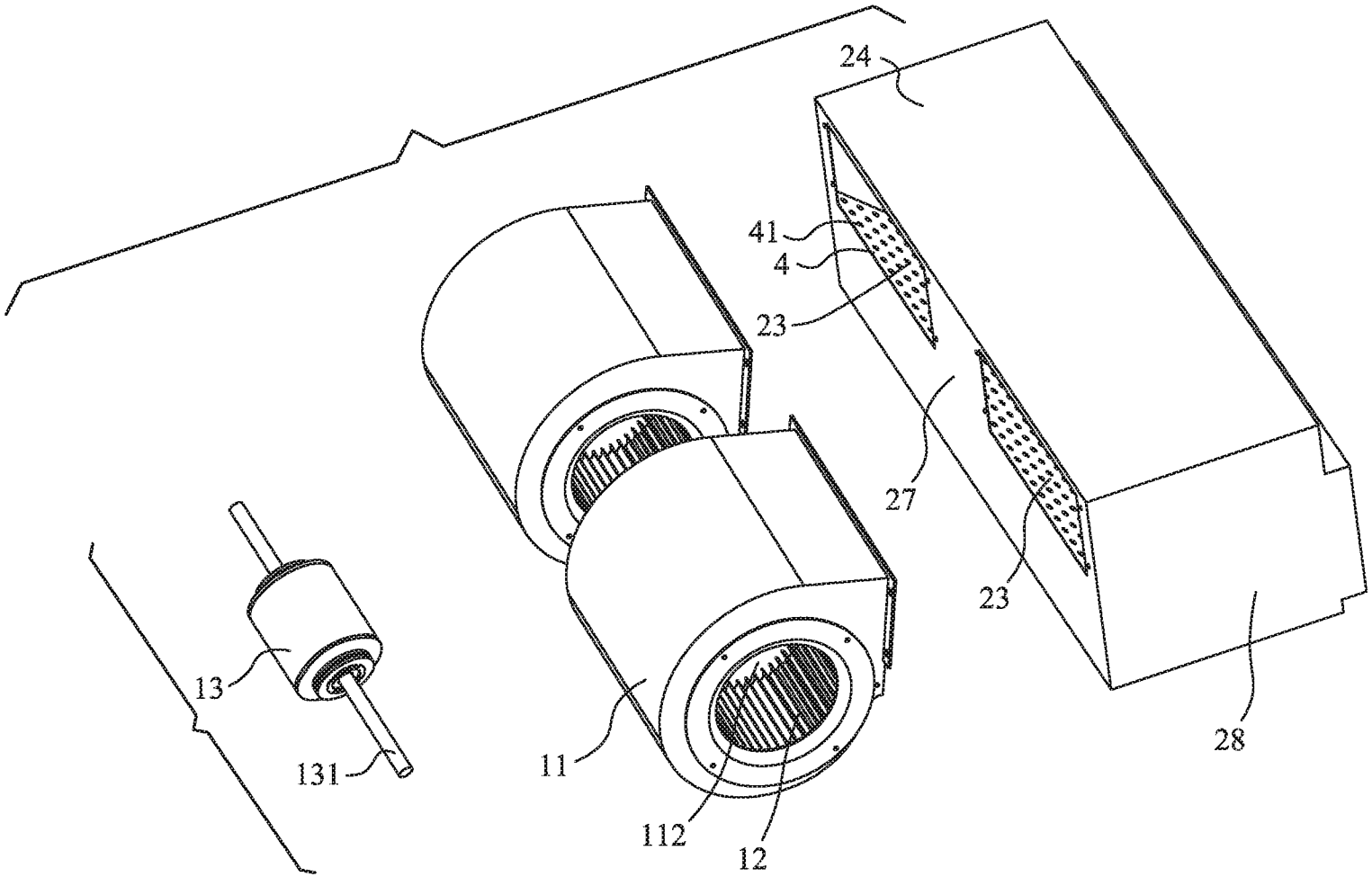
FIG. 14 is an exploded view of a fan coil unit in Example 3 of the disclosure.

As shown in FIGS. 12-14, the fan coil unit in this example is basically the same as that in Example 1 except that: the fan housing 2 comprises a top plate 24, a bottom plate, a rear plate 27, and side plate 28; the bottom plate comprises a baseplate 29 and a guide plate 26 connected to the baseplate 29; the guide plate 26 inclines upwards; an upper end of the guide plate 26 is connected to a bottom of the second air outlet 23; the top plate 24, the baseplate 29, the rear plate 27, and the side plate 28 form a rectangular structure; and the second air outlet 22 is disposed at a top of the rear plate 27.

The heat exchanger 3 is disposed vertically in the second chamber; two ends of the heat exchanger 3 are connected to the top plate 24 and the baseplate 29, respectively; the lower end of the hydrostatic plate 4 is connected to the bottom plate of the fan housing 2.

The hydrostatic plate 4 comprises a plurality of through holes 41, a third chamber 42 is disposed below the hydrostatic plate 4, and third chamber 42 is filled with damping material.

Example 4

Figure 15:
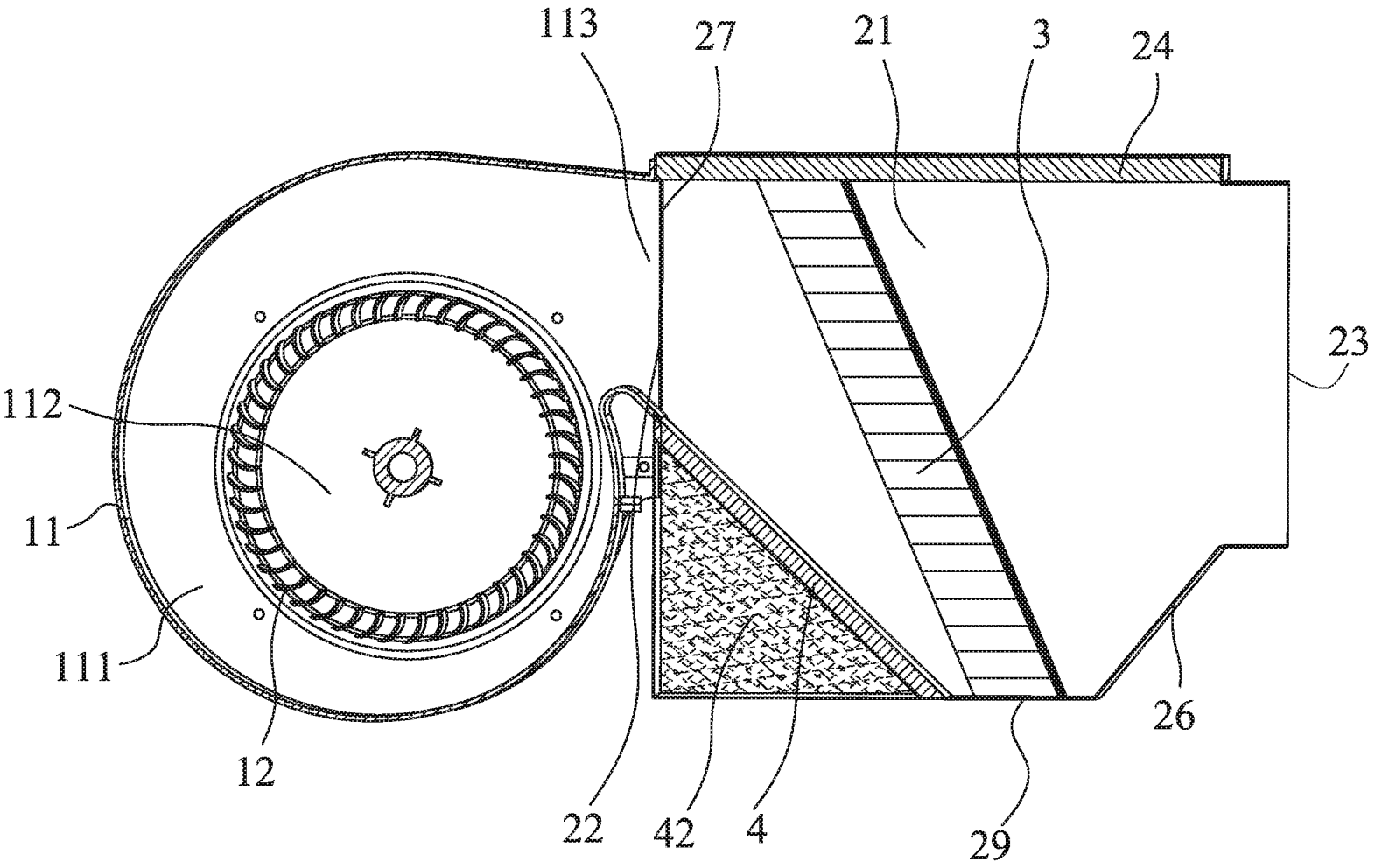
FIG. 15 is a sectional view of a fan coil unit in Example 4 of the disclosure.

As shown in FIG. 15, the fan coil unit in this example is basically the same as that in Example 3 except that: the heat exchanger 3 is slantly disposed.

Example 5

Figure 16:
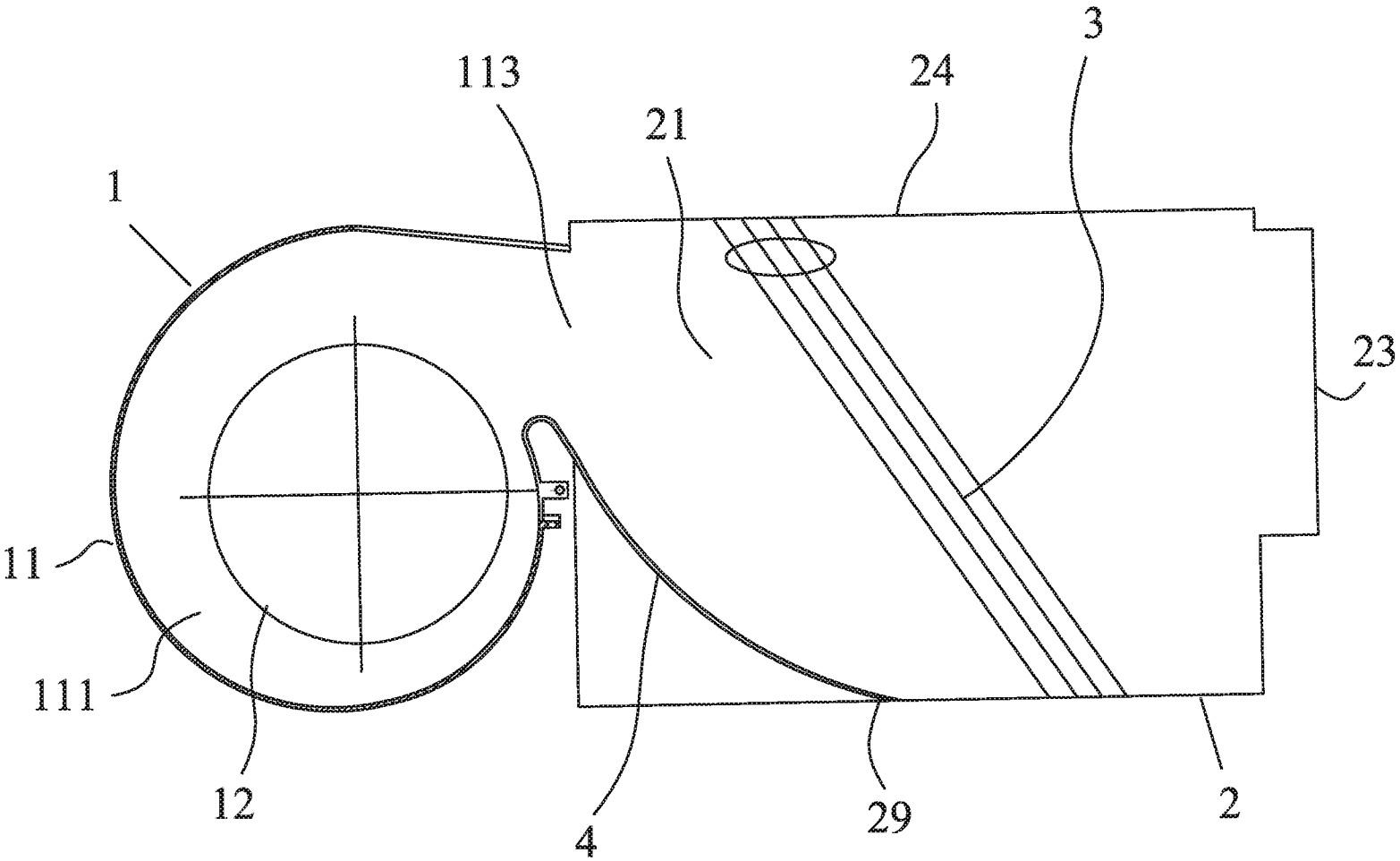
FIG. 16 is a sectional view of a fan coil unit in Example 5 of the disclosure.
Figure 17:
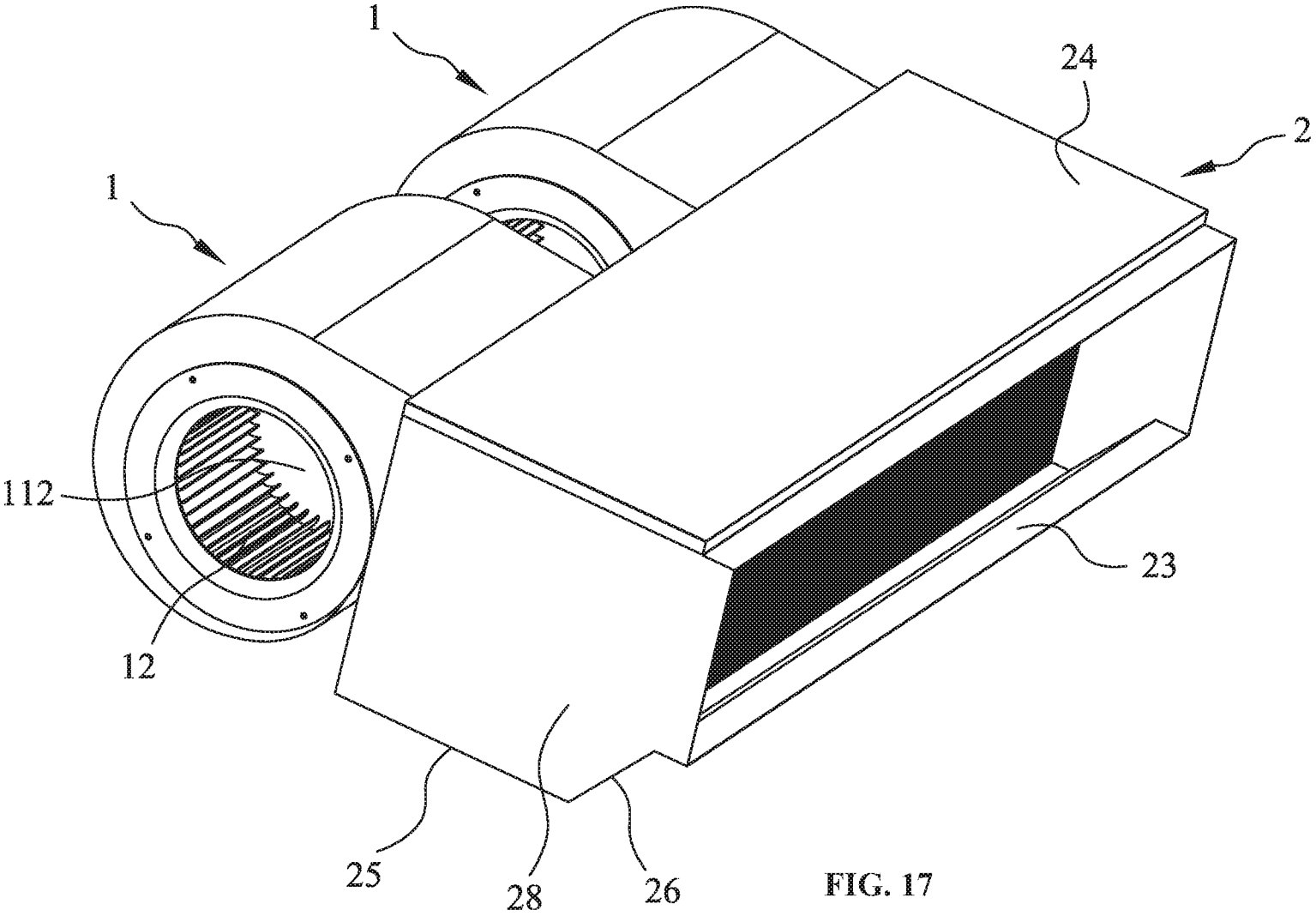
FIG. 17 is a stereogram of a fan coil unit in Example 6 of the disclosure.
Figure 18:
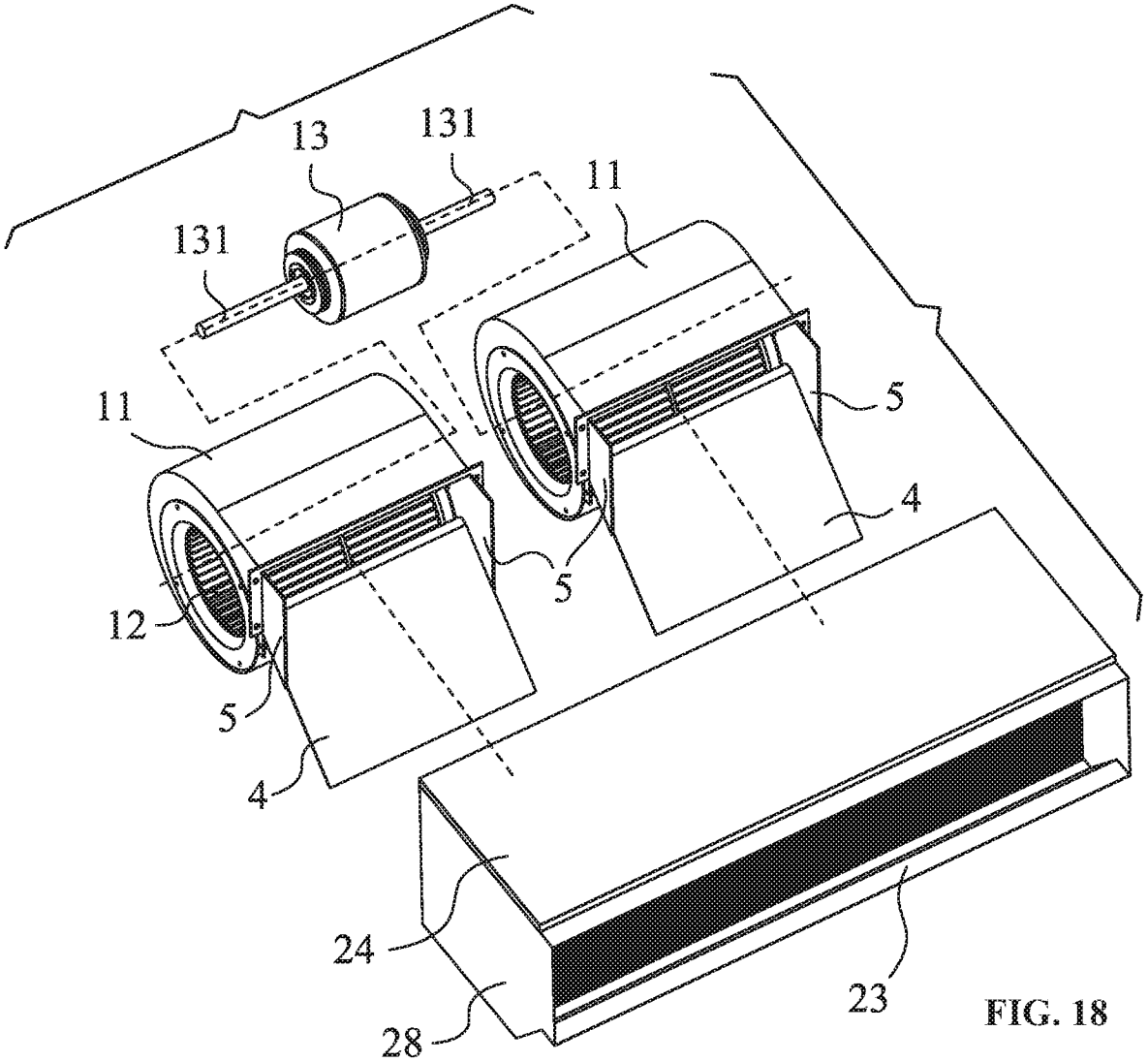
FIG. 18 is an exploded view of a fan coil unit in Example 6 of the disclosure.
Figure 19:
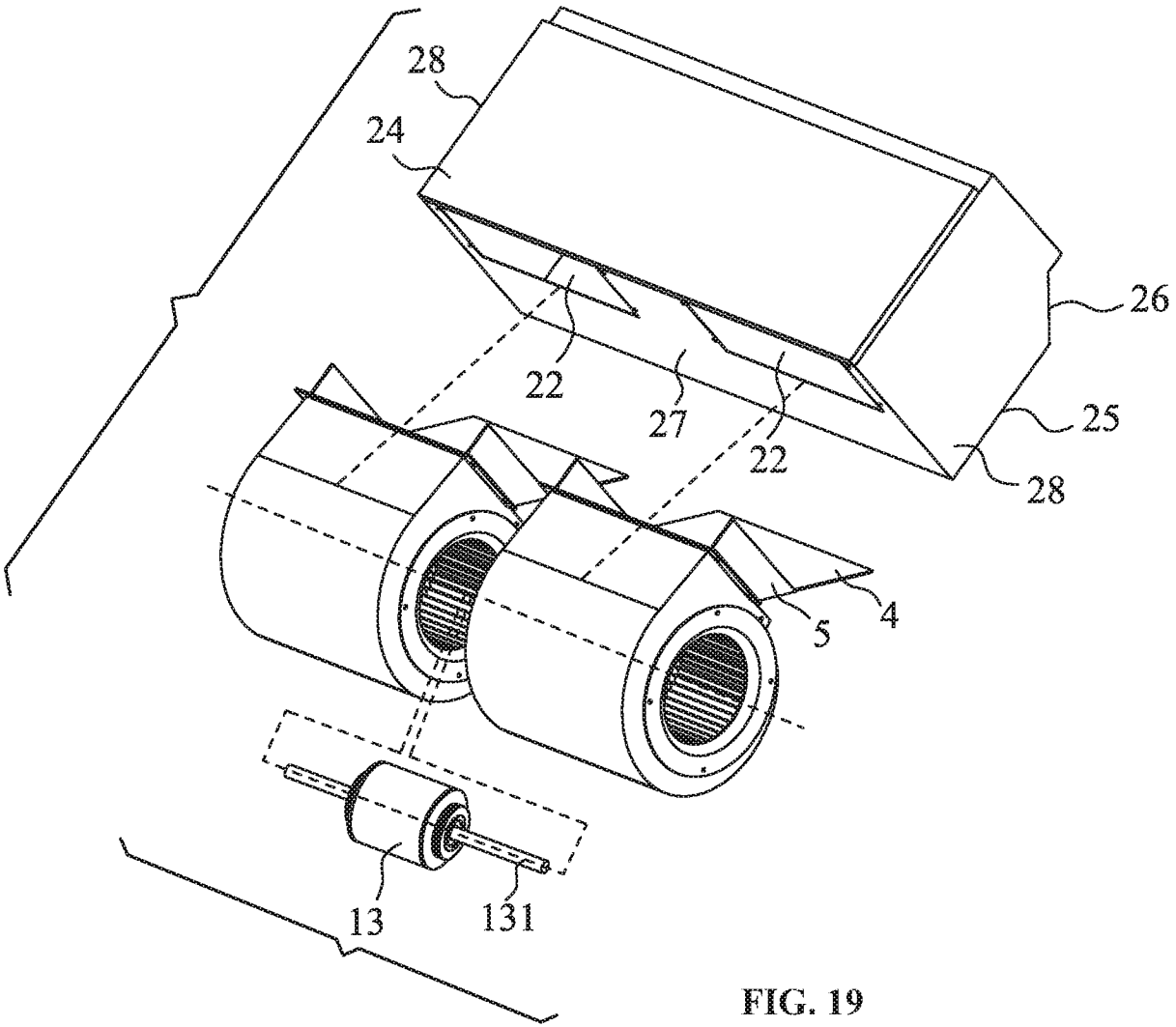
FIG. 19 is another exploded view of a fan coil unit in Example 6 of the disclosure.
Figure 20:
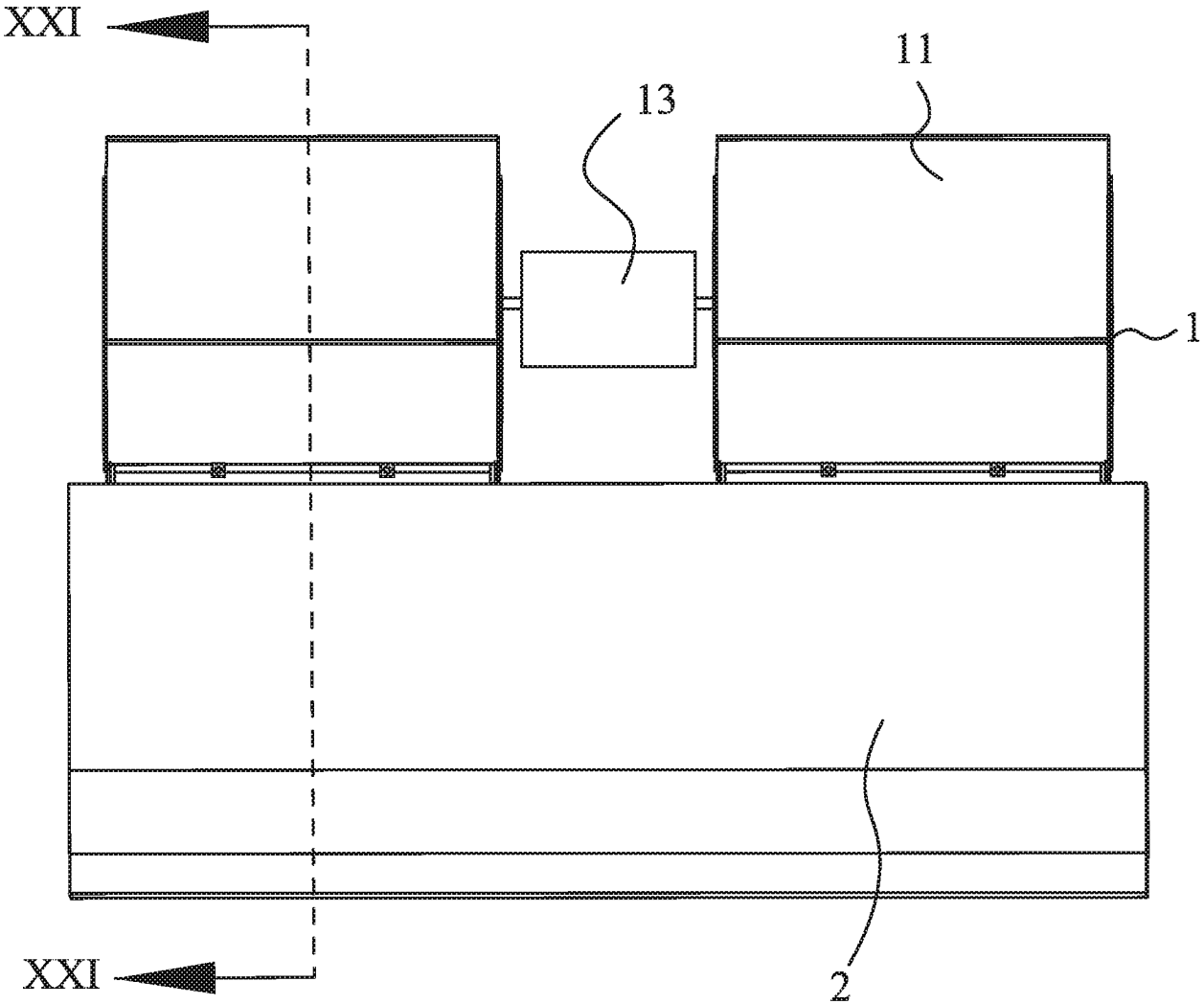
FIG. 20 is a top view of a fan coil unit in Example 6 of the disclosure.
Figure 21:
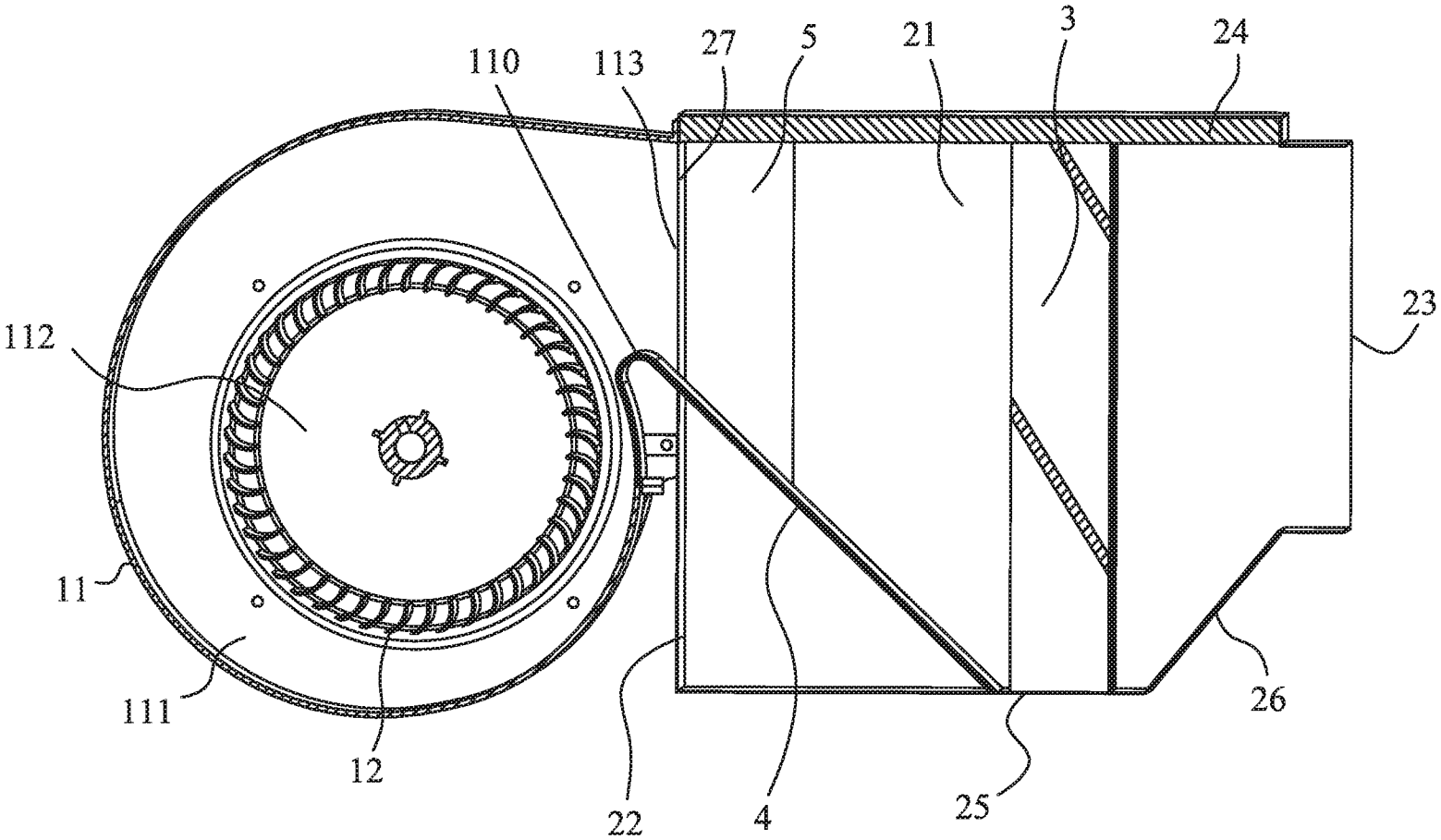
FIG. 21 is a sectional view taken from line XXI-XXI in FIG. 20.
Figure 22:
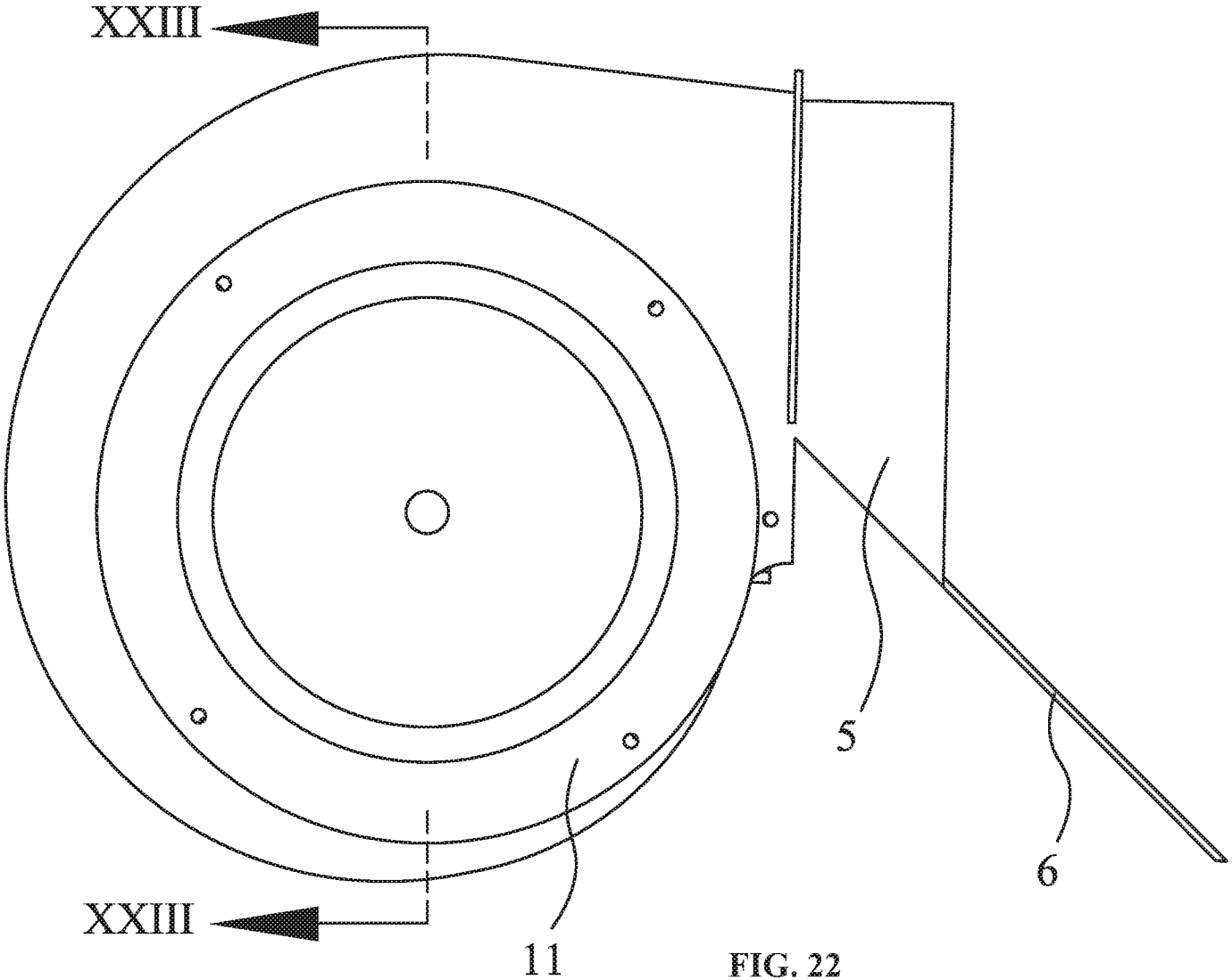
FIG. 22 is a front view of a volute in Example 6 of the disclosure.

As shown in FIG. 16, the fan coil unit in this example is basically the same as that in Example 4 except that: the heat exchanger 3 is slantly disposed; the hydrostatic plate 4 is a curved plate with depressed middle part, the heat exchanger 3 is slantly disposed, and the direction of tilt thereof is the same as that of the hydrostatic plate 4. Specifically, the hydrostatic plate 4 and the heat exchanger 3 tilt towards the same direction.

Example 6

As shown in FIGS. 17-24, a fan coil unit, comprises: a blower 1 comprising a volute 11, a wind wheel 12, and a motor 13; a fan housing 2; a heat exchanger 3; and a hydrostatic plate 4. The volute 11 comprises a first chamber 111, a first air inlet 112, and a first air outlet 113; the wind wheel 12 is disposed in the first chamber 111 of the volute 11; the motor 13 comprises an output shaft 131 which extends into the first chamber 111 and is connected to the wind wheel 12; the fan housing 2 comprises a second chamber 21, a second air inlet 22, and a second air outlet 23; the heat exchanger 3 is disposed in the second chamber 21 and is located between the second air inlet 22 and the second air outlet 23; the volute 11 further comprises a volute tongue which is close to the first air outlet 113; the hydrostatic plate 4 is connected to the volute tongue; the hydrostatic plate 4 is disposed in an inclined way and comprises an upper end and a lower end; and the upper end of the hydrostatic plate 4 is connected to the volute tongue which is close to the first air outlet 113, and the lower end of the hydrostatic plate 4 extends towards the heat exchanger 3. The hydrostatic plate 4 is a flat slab.

The hydrostatic side plates 5 are disposed at two sides of the first air outlet 113, respectively; bottom ends of the hydrostatic side plates 5 are connected to two side ends of the hydrostatic plate 4, and the hydrostatic side plates 5 are vertically disposed with regard to the ground. The hydrostatic side plates 5 extend from the first air outlet 113 to a middle section of the hydrostatic plate 4, and the hydrostatic side plates 5 and the hydrostatic plate 4 are both disposed in the second chamber 21.

The hydrostatic plate 4 is a vertical slab, the second air inlet 22 is located at an upper part of one end of the fan housing 2, and the second air outlet 23 is located at an upper part of the other end of the fan housing 2.

The fan housing 2 comprises a top plate 24, a bottom plate, a rear plate 27, and side plate 28; the bottom plate comprises a baseplate 29 and a guide plate 26 connected to the baseplate 29; the guide plate 26 inclines upwards; an upper end of the guide plate 26 is connected to a bottom of the second air outlet 23; the top plate 24, the baseplate 29, the rear plate 27, and the side plate 28 form a rectangular structure; and the second air outlet 22 is disposed at a top of the rear plate 27.

The heat exchanger 3 is disposed vertically or slantly in the second chamber; two ends of the heat exchanger 3 are connected to the top plate 24 and the bottom plate, respectively.

The middle plate 25 is parallel to the top plate 24. The heat exchanger 3 is disposed vertically or slantly in the second chamber. Two ends of the heat exchanger 3 are connected to the top plate 24 and the middle plate 25, respectively.

The blower 1 comprises two volutes 11, two wind wheels 12, and one motor 13; two second air inlets 22 are disposed at one side of the fan housing 2; the two volutes 11 are respectively disposed at two sides of the motor 13; the two wind wheels 12 are disposed in the two volutes 11, respectively; two shaft extensions of the motor 13 are connected to the two wind wheels 12, respectively; two first air outlets 113 of the two volutes 11 communicate with the two second air inlets 22 of the fan housing 2, respectively.

Figure 23:
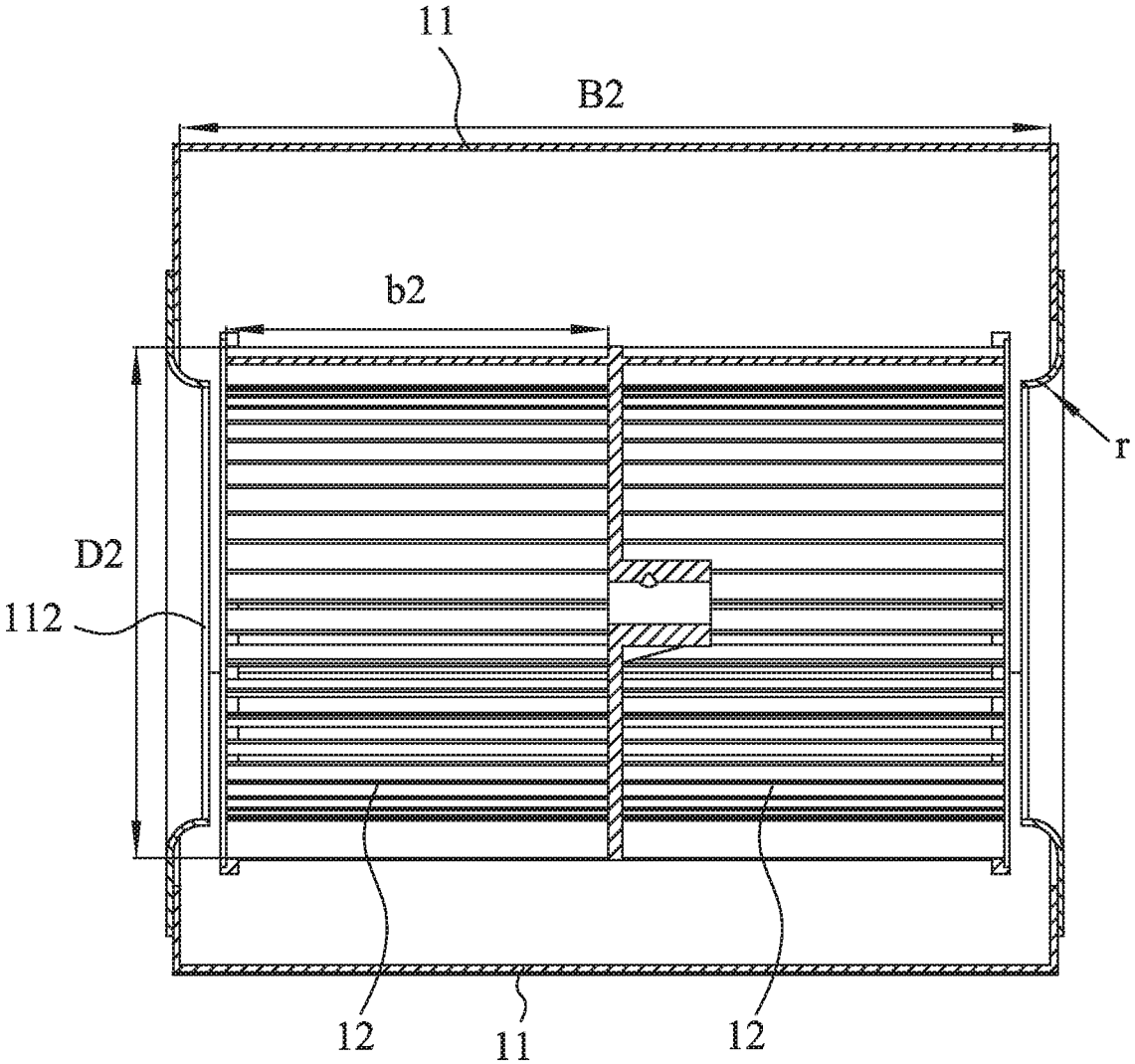
FIG. 23 is a sectional view taken from line XXIII-XXIII in FIG. 22.

As shown in FIG. 23, in the presence of the hydrostatic plate 4 and the hydrostatic side plates 5, the parameters of the volute 11 fulfill the following formula: $1.65 \geq 2*b2/D2 \geq 1.45$, where b2 represents an effective width of the wind wheel 12, and D2 represents an outer diameter of the wind wheel 12. The relation between the effective width of the wind wheel 12 and a width of the volute 11 fulfills the following formula: $0.98 \geq 2*b2/B2 \geq 0.845$, where B2 represents the width of the volute 11. The relation between an arc radius of the first air inlet 112 of the volute 11 and the outer diameter of the wind wheel 12 fulfills the following formula: $0 < r/D2 \leq 0.069$, where r represents the arc radius of the first air inlet 112.

Figure 24:
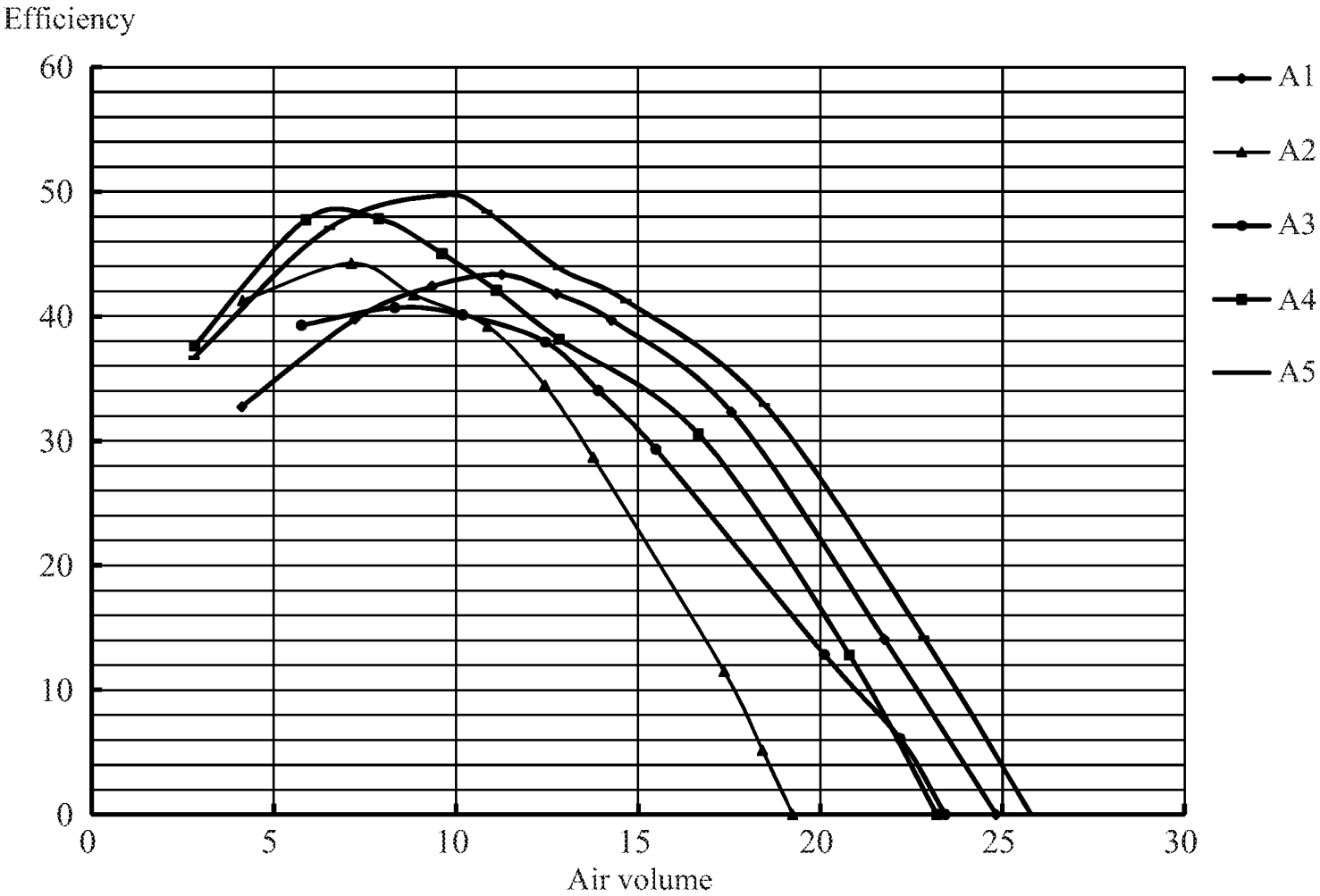
FIG. 24 is a comparison diagram of experimental results in Example 6 of the disclosure.

Based on the abovementioned structural parameters and the testing conditions in Table 6, the following experimental verifications are performed:

The experimental parameters in Table 7 are as follows: 2b2/D2=1.2625, 2b2/B2=0.796, r/D2=0.075. The measured efficiency values corresponding to different air volumes are recorded and used for fitting a curve A1 as shown in FIG. 24.

The experimental parameters in Table 8 are as follows: 2b2/D2=1.4296, 2b2/B2=0.796, r/D2=0.1096. The measured efficiency values corresponding to different air volumes are recorded and used for fitting a curve A2 as shown in FIG. 24.

The experimental parameters in Table 9 are as follows: 2b2/D2=1.43, 2b2/B2=0.832, r/D2=0.163. The measured efficiency values corresponding to different air volumes are recorded and used for fitting a curve A3 as shown in FIG. 24.

The experimental parameters in Table 10 are as follows: 2b2/D2=1.45, 2b2/B2=0.845, r/D2=0.069. The measured efficiency values corresponding to different air volumes are recorded and used for fitting a curve A4 as shown in FIG. 24.

The experimental parameters in Table 11 are as follows: 2b2/D2=1.45, 2b2/B2=0.874, r/D2=0.055. The measured efficiency values corresponding to different air volumes are recorded and used for fitting a curve A5 as shown in FIG. 24.

The experimental parameters in Table 12 are as follows: 2b2/D2=1.48, 2b2/B2=0.894, r/D2=0.047. The measured efficiency values corresponding to different air volumes are recorded.

The experimental parameters in Table 13 are as follows: 2b2/D2=1.65, 2b2/B2=0.98, r/D2=0.03. The measured efficiency values corresponding to different air volumes are recorded.

The curve graph as shown in FIG. 24 is obtained according to the six groups of experimental data, and comprises Curve A1, Curve A2, Curve A3, Curve A4, and Curve A5. Based on the curve graph in FIG. 24, in Curve A4 and Curve A5, the parameters of the volute 11 fulfill the following formula: $1.65 \geq 2*b2/D2 \geq 1.45$, $0.98 \geq 2*b2/B2 \geq 0.845$, and $0 < r/D2 \leq 0.069$, so the work efficiency of the motor is relatively high when the output air volume is between 0 and 10 units. Curve A1, Curve A2 and Curve A3 do not meet the above requirements, so the work efficiency of the motor is relatively low when the output air volume is between 0 and 10 units. In addition, compare the experimental parameters in Tables 12 and 13 with the experimental parameters in Table 11, it is known that the work efficiency of the motor operating under the experimental parameters in Tables 12 and 13 with the output air volume of between 0 and 10 units is relatively high. In practice, the output air volume of the motor is generally between 0 and 10 units, so the core objective of the invention is to find out an operating parameter under which the motor exhibits the highest working efficiency.

TABLE 6

| | | |
|---|---|---|
| Number of revolutions | $n_n$ (rpm) = | 800.00 |
| Normal atmosphere | Pan (hPa) = | 1013.00 |
| Standard temperature | tan (° C.) = | 25.00 |
| Air density | ρa (kg/m$^3$) = | 1.1767 |

TABLE 7

A1:
2b2/D2 = 1.2625 Blower
2b2/B2 = 0.796
r/D2 = 0.075

| | | | | Air outlet of volute | | | Blower | |
|---|---|---|---|---|---|---|---|---|
| Air volume Q (m$^3$/h) | Air volume Q (m$^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1489.55 | 24.83 | 0.02 | 44.23 | 7.82 | 35.99 | 36.02 | 0.02 | 33.69 |
| 1305.88 | 21.76 | 14.88 | 38.41 | 6.86 | 27.66 | 42.55 | 14.06 | 40.19 |
| 1053.72 | 17.56 | 32.95 | 29.85 | 5.53 | 18.01 | 50.96 | 32.32 | 49.98 |
| 856.39 | 14.27 | 40.71 | 24.40 | 4.50 | 11.90 | 52.60 | 39.68 | 51.28 |
| 765.96 | 12.77 | 44.31 | 22.56 | 4.02 | 9.52 | 53.83 | 41.80 | 50.77 |
| 675.75 | 11.26 | 46.72 | 20.23 | 3.55 | 7.41 | 54.13 | 43.36 | 50.23 |

TABLE 7-continued

A1:
2b2/D2 = 1.2625 Blower
2b2/B2 = 0.796
r/D2 = 0.075

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 561.04 | 9.35 | 47.76 | 17.55 | 2.95 | 5.11 | 52.87 | 42.40 | 46.93 |
| 433.58 | 7.23 | 47.96 | 14.52 | 2.28 | 3.05 | 51.00 | 39.77 | 42.30 |
| 247.22 | 4.12 | 48.89 | 10.25 | 1.30 | 0.99 | 49.88 | 32.75 | 33.42 |

TABLE 8

A2:
2b2/D2 = 1.4296
2b2/B2 = 0.796
r/D2 = 0.1096

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1154.66 | 19.24 | 0.01 | 18.18 | 4.18 | 10.26 | 10.27 | 0.02 | 14.23 |
| 1104.61 | 18.41 | 3.69 | 21.94 | 3.99 | 9.39 | 13.08 | 5.16 | 18.29 |
| 1041.53 | 17.36 | 8.19 | 20.61 | 3.77 | 8.35 | 16.54 | 11.50 | 23.22 |
| 825.79 | 13.76 | 19.79 | 15.82 | 2.99 | 5.25 | 25.03 | 28.69 | 36.30 |
| 746.50 | 12.44 | 23.48 | 14.13 | 2.70 | 4.29 | 27.76 | 34.45 | 40.74 |
| 652.10 | 10.87 | 26.52 | 12.25 | 2.36 | 3.27 | 29.79 | 39.21 | 44.04 |
| 531.09 | 8.85 | 29.11 | 10.30 | 1.92 | 2.17 | 31.28 | 41.70 | 44.81 |
| 427.51 | 7.13 | 31.71 | 8.51 | 1.55 | 1.41 | 33.12 | 44.25 | 46.21 |
| 248.67 | 4.14 | 37.41 | 6.26 | 0.90 | 0.48 | 37.89 | 41.28 | 41.81 |

TABLE 9

A3:
2b2/D2 = 1.43
2b2/B2 = 0.832
r/D2 = 0.163

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1405.89 | 23.43 | 0.01 | 26.86 | 4.11 | 9.94 | 9.95 | 0.01 | 11.35 |
| 1331.20 | 22.19 | 5.21 | 31.45 | 3.89 | 8.91 | 14.12 | 6.12 | 16.60 |
| 1206.45 | 20.11 | 10.52 | 27.43 | 3.53 | 7.32 | 17.84 | 12.85 | 21.79 |
| 929.41 | 15.49 | 23.65 | 20.82 | 2.72 | 4.35 | 27.99 | 29.32 | 34.71 |
| 834.20 | 13.90 | 27.19 | 18.50 | 2.44 | 3.50 | 30.69 | 34.06 | 38.45 |
| 746.94 | 12.45 | 30.50 | 16.67 | 2.18 | 2.81 | 33.31 | 37.96 | 41.46 |
| 611.19 | 10.19 | 32.37 | 13.70 | 1.79 | 1.88 | 34.25 | 40.12 | 42.45 |
| 499.12 | 8.32 | 35.01 | 11.92 | 1.46 | 1.25 | 36.26 | 40.71 | 42.17 |
| 345.84 | 5.76 | 41.57 | 10.17 | 1.01 | 0.60 | 42.17 | 39.28 | 39.84 |

TABLE 10

A4:
2b2/D2 = 1.45
2b2/B2 = 0.845
r/D2 = 0.069

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1391.89 | 23.20 | 0.02 | 35.26 | 3.93 | 9.18 | 9.20 | 0.02 | 10.09 |
| 1247.95 | 20.80 | 11.31 | 30.60 | 3.52 | 7.38 | 18.70 | 12.81 | 21.18 |
| 999.17 | 16.65 | 25.13 | 22.83 | 2.82 | 4.73 | 29.86 | 30.55 | 36.31 |
| 769.54 | 12.83 | 31.39 | 17.58 | 2.17 | 2.81 | 34.19 | 38.17 | 41.58 |
| 666.67 | 11.11 | 33.65 | 14.81 | 1.88 | 2.11 | 35.76 | 42.07 | 44.71 |
| 576.99 | 9.62 | 36.57 | 13.01 | 1.63 | 1.58 | 38.14 | 45.04 | 46.98 |
| 472.64 | 7.88 | 38.62 | 10.60 | 1.33 | 1.06 | 39.68 | 47.84 | 49.15 |
| 352.68 | 5.88 | 40.46 | 8.30 | 1.00 | 0.59 | 41.05 | 47.75 | 48.45 |
| 169.83 | 2.83 | 42.24 | 5.30 | 0.48 | 0.14 | 42.38 | 37.62 | 37.74 |

TABLE 11

A5:
2b2/D2 = 1.45
2b2/B2 = 0.874
r/D2 = 0.055

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1547.07 | 25.78 | 0.02 | 41.96 | 4.33 | 11.04 | 11.06 | 0.02 | 11.33 |
| 1370.45 | 22.84 | 13.11 | 35.13 | 3.84 | 8.66 | 21.77 | 14.21 | 23.60 |
| 1108.25 | 18.47 | 28.51 | 26.69 | 3.10 | 5.67 | 34.18 | 32.89 | 39.42 |
| 879.89 | 14.66 | 33.74 | 19.99 | 2.46 | 3.57 | 37.31 | 41.25 | 45.62 |
| 769.23 | 12.82 | 36.49 | 17.77 | 2.15 | 2.73 | 39.22 | 43.87 | 47.16 |
| 650.98 | 10.85 | 38.10 | 14.85 | 1.82 | 1.95 | 40.06 | 48.41 | 48.79 |
| 577.30 | 9.62 | 40.74 | 13.14 | 1.62 | 1.54 | 42.28 | 49.72 | 51.60 |
| 391.82 | 6.53 | 40.95 | 9.46 | 1.10 | 0.71 | 41.66 | 47.11 | 47.92 |
| 168.47 | 2.81 | 41.42 | 5.28 | 0.47 | 0.13 | 41.55 | 36.69 | 36.80 |

TABLE 12

A6:
2b2/D2 = 1.48
2b2/B2 = 0.894
r/D2 = 0.047

| | | | | Air outlet of volute | | | Blower | |
|---|---|---|---|---|---|---|---|---|
| Air volume Q ($m^3$/h) | Air volume Q ($m^3$/min) | Static pressure Ps (Pa) | Output power Lmo (W) | Blowing speed vd (m/s) | Outgoing dynamic pressure Pd (Pa) | Total pressure Pt (Pa) | Static pressure efficiency ηsf (—) | Total pressure efficiency ηtf (—) |
| 1565.22 | 26.09 | 0.03 | 45.33 | 4.17 | 10.25 | 10.28 | 0.03 | 9.86 |
| 1361.08 | 22.68 | 16.42 | 36.14 | 3.63 | 7.75 | 24.17 | 17.18 | 25.29 |
| 1041.01 | 17.35 | 31.43 | 24.79 | 2.78 | 4.53 | 35.97 | 36.66 | 41.95 |
| 811.05 | 13.52 | 36.16 | 18.36 | 2.16 | 2.75 | 38.91 | 44.36 | 47.74 |
| 692.85 | 11.55 | 37.39 | 15.21 | 1.85 | 2.01 | 39.40 | 47.31 | 49.85 |
| 626.57 | 10.44 | 39.68 | 13.49 | 1.67 | 1.64 | 41.33 | 51.21 | 53.33 |
| 535.59 | 8.93 | 41.67 | 11.93 | 1.43 | 1.20 | 42.87 | 51.98 | 53.47 |
| 382.57 | 6.38 | 41.54 | 8.73 | 1.02 | 0.61 | 42.15 | 50.59 | 51.34 |
| 174.75 | 2.91 | 45.67 | 5.42 | 0.47 | 0.13 | 45.80 | 40.89 | 41.00 |

TABLE 13

| A7: 2b2/D2 = 1.65 2b2/B2 = 0.98 r/D2 = 0.03 | | | | | | | | |
|---|---|---|---|---|---|---|---|---|
| | | | | Air outlet of volute | | | Blower | |
| Air volume Q ($m^3$/h) | Air volume Q ($m^3$/min) | Static pressure Ps (Pa) | Output power Lmo (W) | Blowing speed Vd (m/s) | Outgoing dynamic pressure Pd (Pa) | Total pressure Pt (Pa) | Static pressure efficiency Hsf (—) | Total pressure efficiency Htf (—) |
| 1570.11 | 27.12 | 0.04 | 47.53 | 4.01 | 9.55 | 10.18 | 0.04 | 10.64 |
| 1365.01 | 22.91 | 18.29 | 37.25 | 3.42 | 7.14 | 23.48 | 20.76 | 27.53 |
| 1080.11 | 16.99 | 33.28 | 25.83 | 2.85 | 3.54 | 35.61 | 40.98 | 42.15 |
| 800.24 | 14.11 | 36.83 | 20.50 | 1.98 | 2.11 | 38.12 | 46.73 | 49.52 |
| 718.62 | 11.98 | 38.28 | 18.25 | 1.86 | 1.56 | 40.56 | 49.57 | 51.25 |
| 670.35 | 10.55 | 40.18 | 12.03 | 1.57 | 1.20 | 42.12 | 53.16 | 54.84 |
| 550.45 | 9.34 | 42.98 | 10.48 | 1.18 | 0.95 | 43.36 | 53.91 | 55.79 |
| 386.87 | 6.41 | 43.12 | 8.36 | 0.47 | 0.49 | 44.48 | 52.86 | 52.74 |
| 170.63 | 2.99 | 46.82 | 6.18 | 0.29 | 0.13 | 46.99 | 42.56 | 43.58 |

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A fan coil unit, comprising:

a blower comprising a volute, a wind wheel, and a motor; the volute comprising a first chamber, a first air inlet, a first air outlet having two sides, and a volute tongue; and the motor comprising an output shaft;

a heat-exchanger housing comprising a top plate, a bottom plate, a rear plate having a second air inlet, two side plates, a second chamber, and a second air outlet;

a heat exchanger;

an air-guiding plate comprising an upper end, a lower end, and two side ends; and two air-guiding side plates;

wherein:

the wind wheel is disposed in the first chamber of the volute;

the output shaft extends into the first chamber and is connected to the wind wheel;

a top of the first air outlet is connected to a top of the second air inlet;

the heat exchanger is disposed in the second chamber and is located between the second air inlet and the second air outlet;

the volute tongue is disposed adjacent to the first air outlet; and the air-guiding plate is connected to the volute tongue;

the air-guiding plate is disposed in an inclined way;

the upper end of the air-guiding plate is connected to the volute tongue, and the lower end of the air-guiding plate extends towards the heat exchanger;

the two air-guiding side plates are disposed at the two sides of the first air outlet, respectively; and the two air-guiding side plates are connected to the two side ends of the air-guiding plate, respectively;

the lower end of the air-guiding plate is connected to the bottom plate; and the air-guiding plate is inclined with respect to the top plate at an angle a, and 75°>a>30°; parameters of the volute fulfill the following formula: Hscmax>(Hex1+Hex2); Hex1/D2≥0.112; Hex2/D2≤0.685, wherein Hscmax represents a vertical distance between a center of the wind wheel and a highest point of the volute; Hex2 represents a vertical distance between the top of the first air outlet and a top point of the volute tongue; Hex1 represents a vertical distance between the top point of the volute tongue and the center of the wind wheel; and D2 represents an outer diameter of the wind wheel.

2. The fan coil unit of claim 1, wherein the parameters of the volute fulfill the following formula: 1.65≥2*b2/D2≥1.45, where b2 represents an effective width of the wind wheel, and D2 represents an outer diameter of the wind wheel.

3. The fan coil unit of claim 2, wherein a relation between the effective width of the wind wheel and a width of the volute fulfills the following formula: 0.98≥2*b2/B2≥0.845, where B2 represents the width of the volute.

4. The fan coil unit of claim 3, wherein a relation between an arc radius of the first air inlet of the volute and the outer diameter of the wind wheel fulfills the following formula: 0<r/D2≤0.069, where r represents the arc radius of the first air inlet.

5. The fan coil unit of claim 4, wherein the air-guiding side plates are vertically disposed with regard to the top plate.

6. The fan coil unit of claim 5, wherein the air-guiding side plates extend from the first air outlet to a middle section of the air-guiding plate, and the air-guiding side plates and the air-guiding plate are both disposed in the second chamber.

7. The fan coil unit of claim 6, wherein the air-guiding plate comprises a flat surface for guiding air out from the first air outlet into the second chamber, the second air inlet is located at an upper part of the rear plate, and the second air outlet is located at an upper part of the heat-exchanger housing.

8. The fan coil unit of claim 4, wherein the bottom plate comprises a baseplate and a guide plate connected to the baseplate; the guide plate inclines upwards; an upper end of the guide plate is connected to a bottom of the second air outlet; the top plate, the baseplate, the rear plate, and the two side plates form a rectangular structure; and the second air inlet is disposed at an upper part of the rear plate.

9. The fan coil unit of claim 8, wherein the heat exchanger is disposed vertically or slantly in the second chamber; two ends of the heat exchanger are connected to the top plate and the bottom plate, respectively.

10. The fan coil unit of claim 9, wherein the air-guiding plate comprises a plurality of through holes; a third chamber is confined by the rear plate, the two side plates, the air-guiding plate, and the bottom plate; and the third chamber is filled with the damping material.

11. The fan coil unit of claim 4, wherein the second air inlet is disposed at an upper part of the rear plate; the bottom plate comprises a baseplate having a front portion, and a guide plate that is connected to the front portion of the baseplate; the lower end of the air-guiding plate is connected to the front portion of the baseplate; the guide plate inclines upwards; an upper end of the guide plate is connected to a bottom of the second air outlet; and the second air outlet is enclosed by the two side plates, the top plate, and the upper end of the guide plate.

12. The fan coil unit of claim 11, wherein the front portion of the baseplate is parallel to the top plate; the heat exchanger is disposed vertically or slantly in the second chamber; two ends of the heat exchanger are connected to the top plate and the front portion of the baseplate, respectively.

13. The fan coil unit of claim 12, wherein the air-guiding plate is made of a damping material.

14. The fan coil unit of claim 8, wherein the blower comprises two volutes, two wind wheels, and one motor; two second air inlets are disposed at one side of the heat-exchanger housing; the two volutes are respectively disposed at two sides of the motor; the two wind wheels are disposed in the two volutes, respectively; two shaft extensions of the motor are connected to the two wind wheels, respectively; two first air outlets of the two volutes communicate with the two second air inlets of the heat-exchanger housing, respectively.

15. The fan coil unit of claim 14, wherein the air-guiding plate comprises a curved surface for guiding air out from the two first air outlet into the second chamber, the heat exchanger is slantly disposed, and the air-guiding plate and the heat exchanger tilt towards a same direction.

16. The fan coil unit of claim 1, wherein the parameters of the volute fulfill the following formula: $1.65 \geq 2*b2/D2 \geq 1.45$, where b2 represents an effective width of the wind wheel, and D2 represents an outer diameter of the wind wheel.

17. The fan coil unit of claim 16, wherein a relation between the effective width of the wind wheel and a width of the volute fulfills the following formula: $0.98 \geq 2*b2/B2 \geq 0.845$, where B2 represents the width of the volute.

18. The fan coil unit of claim 17, wherein a relation between an arc radius of the first air inlet of the volute and the outer diameter of the wind wheel fulfills the following formula: $0 < r/D2 \leq 0.069$, where r represents the arc radius of the first air inlet.

19. The fan coil unit of claim 18, wherein and the air-guiding side plates are vertically disposed with regard to the top plate.

* * * * *